US010486444B2

(12) United States Patent
Oguchi

(10) Patent No.: US 10,486,444 B2
(45) Date of Patent: Nov. 26, 2019

(54) INK-JET PRINTER

(71) Applicant: Brother Kogyo Kabushiki Kaisha, Nagoya-shi, Aichi-ken (JP)

(72) Inventor: Tomoya Oguchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/924,580

(22) Filed: Mar. 19, 2018

(65) Prior Publication Data

US 2018/0281478 A1 Oct. 4, 2018

(30) Foreign Application Priority Data

Mar. 29, 2017 (JP) ..... 2017-064561

(51) Int. Cl.

| | |
|---|---|
| ***B41J 13/00*** | (2006.01) |
| ***B41J 2/145*** | (2006.01) |
| ***B41J 2/045*** | (2006.01) |
| ***B65H 5/06*** | (2006.01) |
| ***B65H 7/20*** | (2006.01) |

(Continued)

(52) U.S. Cl.

CPC ..... *B41J 13/0009* (2013.01); *B41J 2/04581* (2013.01); *B41J 2/145* (2013.01); *B41J 2/16508* (2013.01); *B41J 2/16511* (2013.01); *B41J 2/16517* (2013.01); *B41J 11/0095* (2013.01); *B41J 13/03* (2013.01); *B65H 5/06* (2013.01); *B65H 7/20* (2013.01); *B65H 2211/00* (2013.01)

(58) Field of Classification Search

CPC .... B41J 29/38; B41J 2/04581; B41J 2/16508; B41J 13/0009; B41J 2/16511; B41J 11/0095; B41J 2/145; B41J 2/16517; B41J 13/03; B65H 5/06; B65H 7/20; B65H 2211/00

See application file for complete search history.

(56) References Cited

U.S. PATENT DOCUMENTS 8,740,344 B2 * 6/2014 Oguchi ..... B41J 13/0009 347/29
9,770,929 B2 9/2017 Horade (Continued)

FOREIGN PATENT DOCUMENTS

| | | |
|---|---|---|
| JP | 3587111 B2 | 11/2004 |
| JP | 2016-140978 A | 8/2016 |
| JP | 2017-007140 A | 1/2017 |

*Primary Examiner* — Jannelle M Lebron
(74) *Attorney, Agent, or Firm* — Banner & Witcoff, Ltd.

(57) ABSTRACT

There is provided an ink-jet printer including: a recording head; a motor; a conveying section; a switching mechanism switching transmittance of driving force of the motor; and a controller. The switching mechanism includes first and second gears. Under a condition that the controller determines that a set value of an execution parameter is a first value, the controller rotates the motor in clockwise and counterclockwise directions just for a first number of times in a process of moving the first gear from a second position to a first position; whereas under a condition that the controller determines that the set value of the execution parameter is a second value, the controller rotates the motor in the clockwise and counterclockwise directions just for a second number of times, smaller than the first number of times, in the process of moving the first gear from the second position to the first position.

12 Claims, 9 Drawing Sheets

(51) Int. Cl.

| | |
|---|---|
| ***B41J 13/03*** | (2006.01) |
| ***B41J 11/00*** | (2006.01) |
| ***B41J 2/165*** | (2006.01) |

(56) References Cited

U.S. PATENT DOCUMENTS

| | | | | |
|---|---|---|---|---|
| 2001/0020962 | A1 | 9/2001 | Kanaya et al. | |
| 2005/0024426 | A1* | 2/2005 | Okamoto | B41J 2/16523 347/36 |
| 2016/0224876 | A1 | 8/2016 | Horade | |
| 2016/0288547 | A1 | 10/2016 | Aoki et al. | |

* cited by examiner

INK-JET PRINTER

CROSS REFERENCE TO RELATED APPLICATION

The present application claims priority from Japanese Patent Application No. 2017-064561 filed on Mar. 29, 2017 the disclosure of which is incorporated herein by reference in its entirety.

BACKGROUND

Field of the Invention:

The present teaching relates to an ink-jet printer configured to record an image, etc. on a sheet.

Description of the Related Art:

Conventionally, an attempt is made, in an information processing apparatus and a printer which are connected to each other via a communication network, to shorten FPOT (abbreviation of First Print Out Time) that is a time since a print instruction or command is input to the information processing apparatus (terminal) until a first sheet is discharged from the printer. Further, as one of the methods for shortening the FPOT, it is considered to shorten the time for a preparing processing.

The preparing processing is a processing that the printer should execute before the printer records an image on a sheet, and is exemplified, for example, by a drive switching processing for switching a transmittance destination to which the driving force generated by a motor is transmitted, and an initial conveying processing for conveying the sheet up to a position at which the sheet faces (is opposite to) a recording head.

The respective processings composing the preparing processing include a processing which cannot be executed unless another processing or processings is/are ended, a processing which is executable in parallel with another processing or processings, etc. Therefore, the execution time for the preparing processing is a sum of the executing times of the respective processings which are executed in series. On the other hand, the execution time of each of the respective processings composing the preparing processing is set to be longer than a minimum required time so as to reduce any load on the constitutive elements or parts (for example, a motor, a gear, an electronic circuit, etc.) of the ink-jet recording apparatus. Accordingly, simply reducing the execution time of each of the respective processings composing the preparing processing would not be appropriate or suitable.

The present teaching has been made in view of the above-described situation, and an object of the present teaching is to provide an ink-jet recording apparatus, such an ink-jet printer, which is capable of shortening the FPOT while reducing the load on the constitutive elements or parts of the ink-jet recording apparatus.

SUMMARY

According to an aspect of the present teaching, there is provided an ink-jet printer including: a recording head having nozzles; a conveyor configured to convey a medium in a conveyance direction; a motor; a switching mechanism configured to switch a transmitting state and a non-transmitting state, the transmitting state being a state in which the switching mechanism transmits a driving force of the motor to the conveyor, and the non-transmitting state being a state in which the switching mechanism does not transmit the driving force of the motor to the conveyor, and a controller. The switching mechanism includes: a first gear movable between a first position and a second position; and a second gear configured to mesh with the first gear. The switching mechanism is switched to the transmitting state under a condition that the second gear is meshed with the first gear located at the first position, and the switching mechanism is switched to the non-transmitting state under a condition that the second gear is separated and away from the first gear being moved to a position different from the first position. In a case that the controller obtains an instruction of recording for instructing execution of recording of an image on the medium in accordance with an execution condition indicated by an execution parameter, the controller is configured to perform: determining whether a set value of the execution parameter is a first value or a second value by which an execution time of the recording of the image on the medium becomes shorter than that by the first value; causing the first gear to move from the second position toward the first position so as to execute switching of the switching mechanism from the non-transmitting state toward the transmitting state; under a condition that the controller determines that the set value of the execution parameter is the first value, causing the motor to perform clockwise and counterclockwise rotations for a first number of times in a process during which the controller causes the first gear to move from the second position toward the first position; under a condition that the controller determines that the set value of the execution parameter is the second value, causing the motor to perform the clockwise and counterclockwise rotations for a second number of times, which is smaller than the first number of times, in the process during which the controller causes the first gear to move from the second position toward the first position; causing the conveyor to convey the medium up to an initial setting position at which an initial recording area, of the medium, on which the image is to be recorded first, is capable of facing the recording head; and causing the recording head to jet the ink selectively from the nozzles, in accordance with the instruction of recording, so as to record the image on the initial recording area, of the medium, facing the recording head.

In a case that the execution time during which the recording of the image on the sheet is executed is relatively short, the execution time during which the controller executes the switching of the switching section from the non-transmitting state to the transmitting state has a large impact on the FPOT. In view of this, in a case that the second value is set in the execution parameter, it is possible to shorten the FPOT by rotating the motor in the clockwise and counterclockwise directions (performing clockwise and counterclockwise rotations of the motor; hereinafter referred to as a "jiggling") for the second number of times.

Note that the first and second gears can be meshed with each other appropriately by the jiggling performed for the second number of times. However, in a case that an attempt is made to mesh the first and second gears with each other with the jiggling performed for a small number of times, any slight load is consequently accumulated in each of the gears. In view of this, in a case that the execution time during which the recording of the image on the sheet is executed is long, even the shortening of the execution time during which the controller executes the switching of the switching section from the non-transmitting state to the transmitting state does not contribute to the shortening of the FPOT. Therefore, by performing the jiggling for the first number of times, which is greater than the second number of times, it is possible to reduce the load accumulated in the gears.

According to the present teaching, by performing the switching of the number of times for executing the jiggling, depending on the set value of the execution parameter, it is possible to obtain an ink-jet recording apparatus, such as an ink-jet printer, capable of realizing both of the shortening of the FPOT and the reduction of the load accumulated in the gears.

BRIEF DESCRIPTION OF THE DRAWINGS

FIGS. 5A, 5B and 5C are each a view schematically depicting the configuration of a switching section 170, wherein FIG. 5A depicts a first state, FIG. 5B depicts a second state, and FIG. 5C depicts a third state of the switching section 170.

DESCRIPTION OF THE EMBODIMENTS

Figure 1:
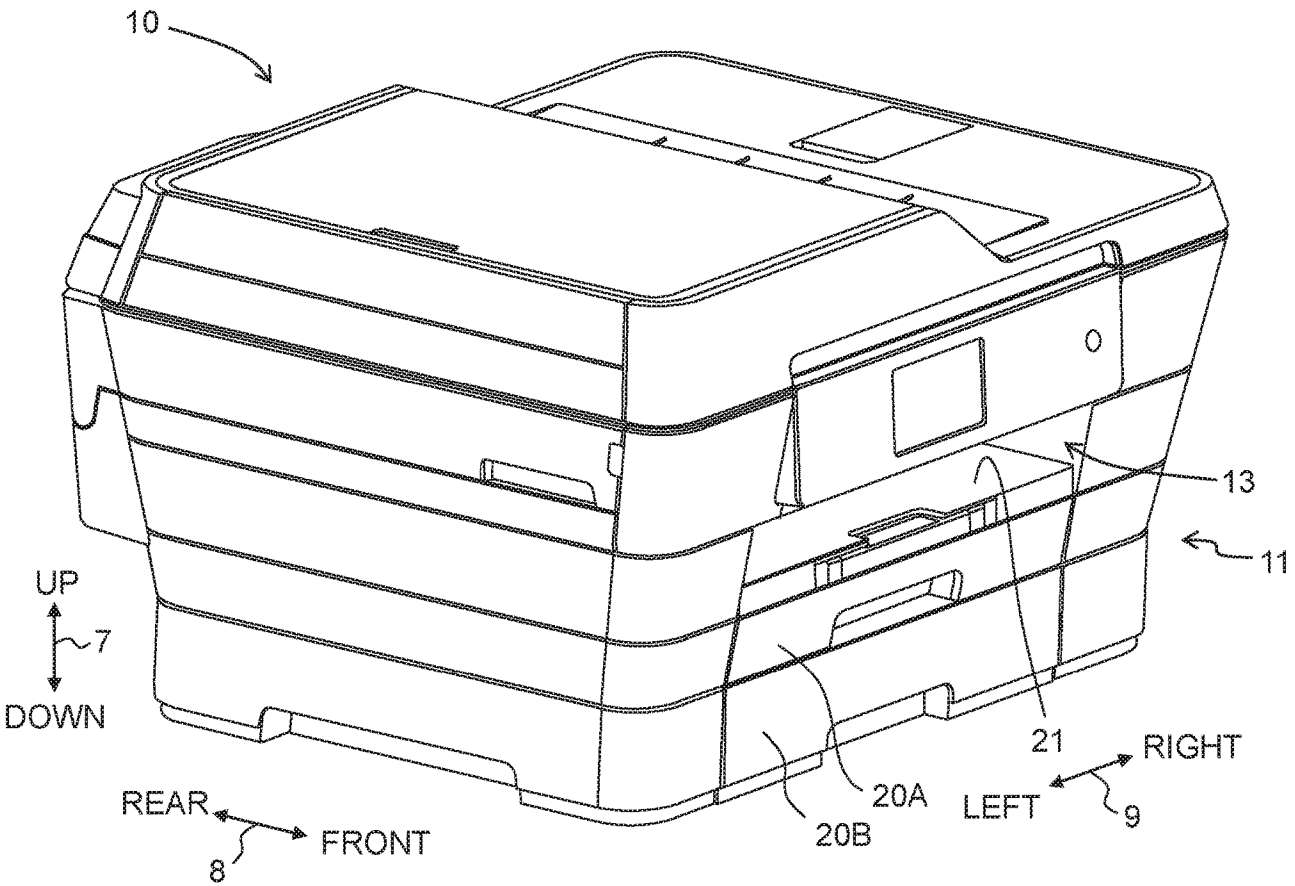
FIG. 1 is a perspective view depicting the outer appearance of a multi-function peripheral 10.

In the following, an embodiment of the present teaching will be explained, with reference to the drawings. Note that, however, the embodiment explained below is merely an example of the present teaching; it goes without saying that it is possible to make any appropriate change(s) in the embodiment of the present teaching without departing from the gist and/or scope of the present teaching. In the following explanation, an up-down direction 7 is defined with a state in which a multi-function peripheral 10 is usably installed (a usable state; a state depicted in FIG. 1), as the reference; a front-rear direction 8 is defined, with a side on which an opening 13 of the multi-function peripheral 10 is provided is designated as the frontward side (front surface or front side); and a left-right direction 9 is defined as viewing the multi-function peripheral 10 from the frontward side (front surface).

<Overall Configuration of Multi-Function Peripheral 10>

As depicted in FIG. 1, the multi-function peripheral 10 is formed to have a substantially rectangular parallelepiped shape. The multi-function peripheral 10 includes a printer 11. The multi-function peripheral 10 is an example of an ink-jet recording apparatus. Further, the multi-function peripheral 10 may further include, for example, a scanner which is configured to read an original (manuscript) and to generate an image data of an image in the original; etc.

<Printer 11>

Figure 2:
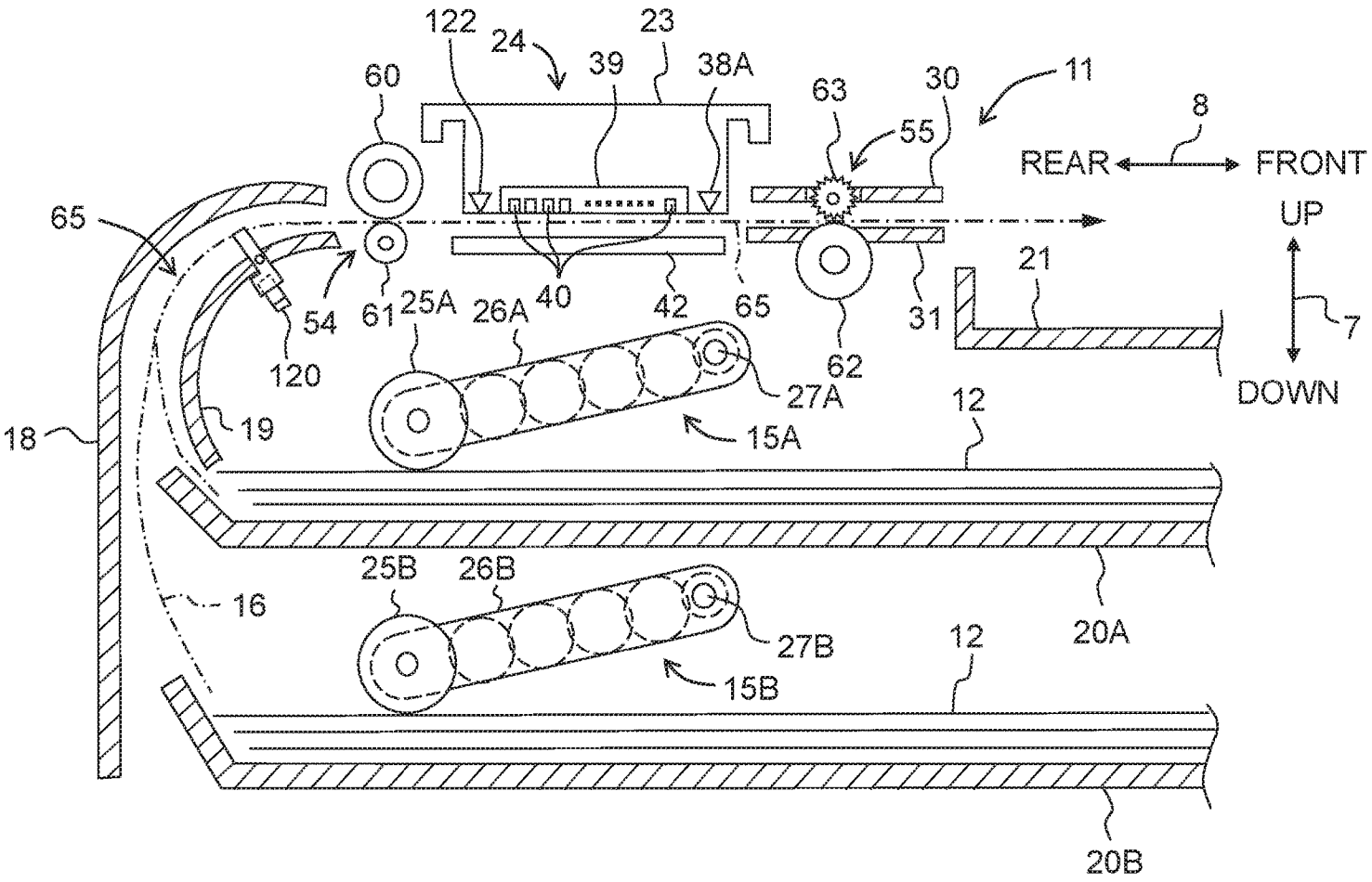
FIG. 2 is a vertical cross-sectional view schematically depicting the internal structure of a printer 11.

The printer 11 records an image, indicated by the image data, on a sheet 12 (see FIG. 2) by jetting or discharging an ink onto the sheet 12. Namely, the printer 11 adopts a so-called ink-jet recording system. As depicted in FIG. 2, the printer 11 is provided with feeding sections 15A and 15B as an example of a conveying section, feed trays 20A and 20B, a discharge tray 21, a conveyance roller section 54, a recording section 24, a discharge roller section 55, and a platen 42.

<Feed Trays 20A and 20B, Discharge Tray 21>

The opening 13 (see FIG. 1) is formed in the front surface of the printer 11. The feed trays 20A and 20B are inserted into or removed from the printer 11 in the front-rear direction 8 through the opening 13. The feed trays 20A and 20B each support a plurality of pieces of the sheet 12 that are stacked in the feed tray 20A, 20B. The discharge tray 21 supports the sheet 12 discharged by the discharge roller section 55 via the opening 13.

<Feeding Sections 15A and 15B>

As depicted in FIG. 2, the feeding section 15A includes a feeding roller 25A, a feeding arm 26A, and a shaft 27A. The feeding roller 25A is rotatably supported by the feeding arm 26A at a front end thereof. The feeding arm 26A is pivotably supported by the shaft 27A supported by a frame of the printer 11. The feeding arm 26A is urged toward the feeding tray 20A by a bias which is applied thereto by an elastic force of a spring or by the self-weight of the feeding arm 26A such that the feeding arm 26A is pivoted toward the feed tray 20A. The feeding section 15B includes a feeding roller 25B, a feeding arm 26B, and a shaft 27B. Since the specific construction of the feeding section 15B is common with that of the feeding section 15A, the explanation therefor will be omitted. The feeding section 15A feeds, with the feeding roller 25A, a sheet 12 supported by the feed tray 20A to a conveyance route 65. The feeding roller 25A is rotated by a driving force generated by the rotation of a feeding motor 101 (see FIG. 6) in a normal direction and transmitted to the feeding roller 25A. The feeding section 15B feeds, with the feeding roller 25B, a sheet 12 supported by the feed tray 20B to the conveyance route 65. The feeding roller 25B is rotated by a driving force generated by the rotation of the feeding motor 101 in the normal direction and transmitted to the feeding roller 25B.

<Conveyance Route 65>

The conveyance route 65 is defined by guide members 18 and 30 and guide members 19 and 31. The guide member 18 and the guide member 19 face with each other with a predetermined interval or gap intervened therebetween and the guide member 30 and the guide member 31 face with each other with a predetermined interval intervened therebetween, in the interior of the printer 11. The conveyance route 65 is a route or path which extends from rear-end portions of the feed trays 20A and 20B toward the rear side of the printer 11. Further, the conveyance route 65 makes a U-turn frontwardly while extending from the lower side to the upper side, at the rear side of the printer 11; and then the conveyance route 65 reaches the discharge tray 21 via the recording section 24. Note that a conveyance direction 16 in which the sheet 12 is conveyed inside the conveyance route 65 is indicated by an arrow of a dot-dash chain line in FIG. 2.

<Conveyance Roller Section 54>

The conveyance roller section 54 is arranged on the upstream side from the recording section 24 in the conveyance direction 16. The conveyance roller section 54 includes a conveyance roller 60 and a pinch roller 61 which are facing each other. The conveyance roller 60 is driven by a conveyance motor 102 (see FIG. 6). The pinch roller 61 rotates following the rotation of the conveyance roller 60. The sheet 12 is conveyed in the conveyance direction 16 by being pinched between the conveyance roller 60 and the pinch roller 61. In this situation, the conveyance roller 60 is rotated in the normal direction (rotated normally or positively) by being transmitted with a driving force generated by the rotation of the conveyance motor 102 in the normal direction. Further, the conveyance roller 60 rotates in a reverse direction, which is reverse to that of the normal direction of the normal rotation, by being transmitted with a driving force generated by the rotation of the conveyance motor 102 in the reverse direction.

<Discharge Roller Section 55>

The discharge roller section 55 is arranged downstream from the recording section 24 in the conveyance direction 16. The discharge roller section 55 includes a discharge roller 62 and a spur 63 which are facing each other. The discharge roller 62 is driven by the conveyance motor 102. The spur 63 rotates following the rotation of the discharge roller 62. The sheet 12 is conveyed in the conveyance direction 16 by being pinched between the discharge roller 62 and the spur 63. In this situation, the discharge roller 62 is rotated in the normal direction by being transmitted with the driving force generated by the rotation of the conveyance motor 102 in the normal direction.

<Registration Sensor 120>

As depicted in FIG. 2, the printer 11 is provided with a registration sensor 120. The registration sensor 120 is arranged upstream from the conveyance roller section 54 in the conveyance direction 16. The registration sensor 120 is an example of a sheet sensor configured to detect presence or absence of the sheet 12 at a location, within the conveyance route 65 of the sheet 12, on the upstream side from the recording head 24 in the conveyance direction 16. The registration sensor 120 outputs different detection signals, depending on whether or not the sheet 12 is present at an arrangement position. Under a condition that the sheet 12 is present at the arrangement position, the registration sensor 120 outputs a HIGH level signal to a controller 130 (to be described later on; see FIG. 6). On the other hand, under a condition that the sheet 12 is not present (is absent) at the arrangement position, the registration sensor 120 outputs a LOW level signal to controller 130.

<Rotary Encoder 121>

Figure 6:
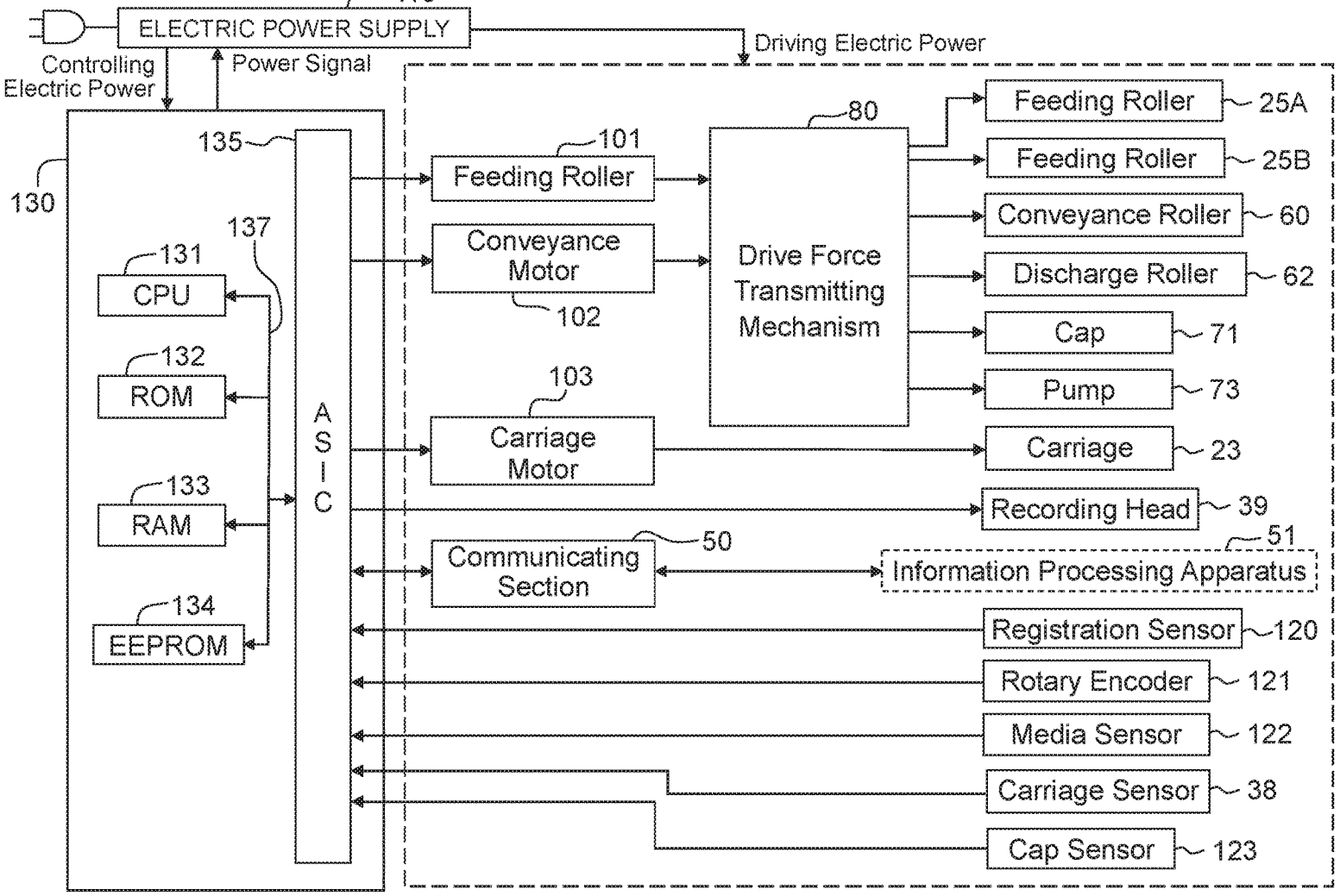
FIG. 6 is a block diagram of the multi-function peripheral 10.

As depicted in FIG. 6, the printer 11 is provided with a rotary encoder 121 which is configured to generate a pulse signal depending on the rotation of the conveyance roller 60 (in other words, the rotary driving of the conveyance motor 102). The rotary encoder 121 is provided with an encoder disc and an optical sensor. The encoder disc rotates together with the rotation of the conveyance roller 60. The optical sensor reads the rotating encoder disc so as to generate a pulse signal, and outputs the generated pulse signal to the controller 130.

<Recording Section 24>

Figure 3:
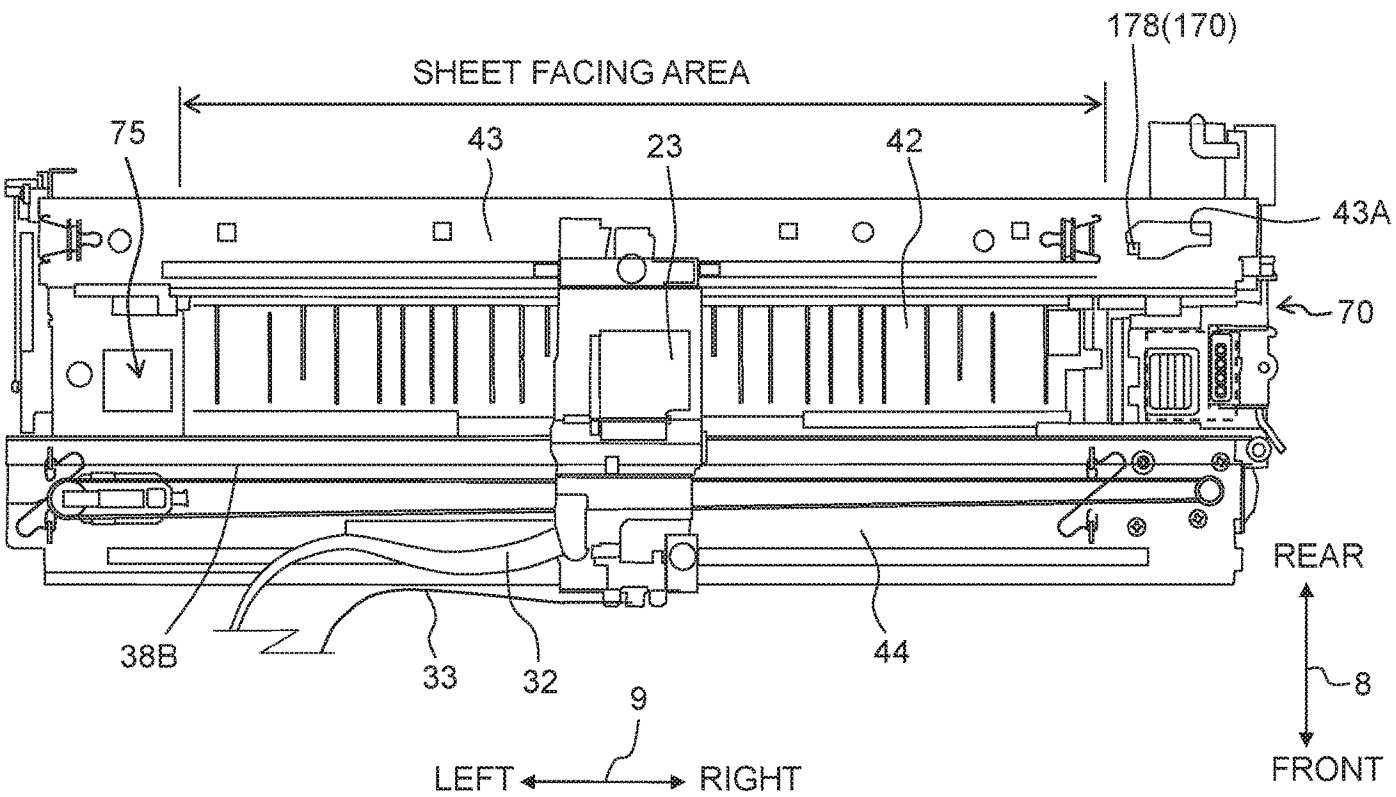
FIG. 3 is a plane view of a carriage 23 and guide rails 43 and 44.

As depicted in FIG. 2, the recording section 24 is arranged between the conveyance roller section 54 and the discharge roller section 55 in the conveyance direction 16. Further, the recording section 24 is arranged to face the platen 42 in the up-down direction 7. Furthermore, the recording section 24 includes a carriage 23, a recording head 39, an encoder sensor 38A and a media sensor 122. Further, as depicted in FIG. 3, an ink tube 32 and a flexible flat cable 33 are connected to the carriage 23. An ink in an ink cartridge is supplied to the recording head 39 via the ink tube 32. The flexible flat cable 33 electrically connects the recording head 39 to a control circuit board having the controller 130 mounted thereon.

As depicted in FIG. 3, the carriage 23 is supported by guide rails 43 and 44 which are extended respectively in the left-right direction 9, at positions separated respectively in the front-rear direction 8. The carriage 23 is connected to a known belt mechanism disposed on the guide rail 44. Note that the belt mechanism is driven by a carriage motor 103 (see FIG. 6). Namely, the carriage 23, connected to the belt mechanism which circumferentially moves by being driven by the carriage motor 103, is capable of reciprocating in the left-right direction 9 in an area including a sheet facing area.

The sheet facing area means an area in a main scanning direction in which an object such as the carriage 23 may face a sheet 12 conveyed by the conveyance roller section 54 and the discharge roller section 55. In other words, the sheet facing area means an area which is included in a space located above the sheet conveyed onto the platen 42 by the conveyance roller section 54 and the discharge roller section 55 and in which the carriage 23 may pass therethrough. Further, the carriage 23 is capable of moving in the left-right direction 9 between an area located on the left side from the sheet facing area and another area located on the right side from the sheet facing area. The left-right direction 9 is an example of the main scanning direction.

As depicted in FIG. 2, the recording head 39 is installed or mounted on the carriage 23. A plurality of nozzles 40 is formed in the lower surface of the recording head 39 (in the following description, the lower surface of the recording head 39 will be referred to as a "nozzle surface"). Further, the recording head 39 has a plurality of driving elements which correspond to the plurality of nozzles 40, respectively. Namely, the recording head 39 has a plurality of nozzles and a plurality of driving elements as a plurality of sets thereof, each of the sets including one of the plurality of nozzles and one of the plurality of driving elements. In the recording head 39, each of the driving elements such as a piezoelectric element is vibrated to thereby jet or discharge an ink droplet of an ink through one of the nozzles 40. In a process during which the carriage 23 is moved, the recording head 39 jets the ink droplets toward the sheet 12 supported by the platen 42. Accordingly, an image, etc. is recorded on the sheet 12.

The driving element is an example of a jetting energy-generating element which generates, from driving voltage applied by an electric power supply 110 (see FIG. 6), an energy for causing the ink droplet to be jetted or discharged from the nozzle 40 (namely, the vibrational energy). Note that, however, the specific example of the jetting-energy generating element is not limited to the driving element, and may be, for example, a heater which generates thermal energy. Further, the heater may heat the ink by thermal energy generated from a driving voltage applied by the electrical power supply 110, and may cause an ink droplet, which is foamed by being heated, to be jetted from the nozzle. Furthermore, although the recording head 39 according to the present embodiment jets a pigment ink, the recording head 30 may jet a dye ink.

The plurality of nozzles 40 are arranged in rows in the front-rear direction 8 and the left-right direction 9, as depicted in FIGS. 2 and 4. The nozzles 40 arranged to form a row in the front-rear direction 8 (hereinafter referred to as a "nozzle row") jet ink droplets of a same color. The nozzle surface is formed with 24 nozzle rows which are arranged in the left-right direction 9. Further, every six adjacent nozzle rows, among the 24 nozzle rows, jet ink droplets of a same color ink. In the present embodiment, among the 24 nozzle rows, six nozzle rows from the right end jet ink droplets of a black ink, another six nozzle rows adjacent to the six nozzle rows jet ink droplets of a yellow ink, yet another six nozzle rows adjacent to the another six nozzle rows jet ink droplets of a cyan ink, and still yet another six nozzle rows from the left end jet ink droplets of a magenta ink. Note that, however, the combination of the number of the nozzle row and the colors of inks to be jetted are not limited to the above-described examples.

Further, an encoder strip 38B, which has a band-shape and which extends in the left-right direction 9, is arranged on the guide rail 44, as depicted in FIG. 3. The encoder sensor 38A is mounted on the lower surface of the carriage 23 at a position at which the encoder sensor 38A faces the encoder strip 38B. In a process in which the carriage 23 is moved, the encoder sensor 38A reads the encoder strip 38B to thereby generate a pulse signal, and outputs the generated pulse signal to the controller 130. The encoder sensor 38A and the encoder strip 38B construct a carriage sensor 38 (see FIG. 6).

<Media Sensor 122>

As depicted in FIG. 2, the media sensor 122 is mounted on the carriage 23 at the lower surface (surface facing the platen 42) of the carriage 23. The media sensor 122 is provided with a light emitting section constructed of a light emitting diode, etc., and a light receiving section constructed of an optical sensor, etc. The light emitting section irradiates a light at a light amount instructed by the controller 130 toward the platen 42. The light irradiated from the light emitting section is reflected by the platen 42 or a sheet 12 supported by the platen 42, and the reflected light is received by the light receiving section. The media sensor 122 outputs, to the controller 130, a detection signal depending on a light receiving amount in the light receiving section. For example, as the light receiving amount is greater, the media sensor 122 outputs a detection signal of higher level to the controller 130.

<Platen 42>

As depicted in FIG. 2, the platen 42 is arranged between the conveyance roller section 54 and the discharge roller section 55 in the conveyance direction 16. The platen 42 is arranged so as to face the recording section 24 in the up-down direction 7. The plane 42 supports the sheet 12, conveyed by at least one of the conveyance roller section 54 and the discharge roller section 55, from therebelow. The light reflectance of the platen 42 in the present embodiment is set to be lower than that of the sheet 12.

<Maintenance Section 70>

As depicted in FIG. 3, the printer 11 is further provided with a maintenance section 70. The maintenance section 70 is configured to perform maintenance for the recording head 39. More specifically, the maintenance section 70 executes a purge operation of removing an ink, air, etc. inside the nozzles 40, and any foreign matter or substance adhered to the nozzle surface. In the following explanation, the ink, air, etc., inside the nozzles 40 and any foreign matter or substance adhered to the nozzle surface are referred to as the "ink, etc.". The ink, etc., removed by the maintenance section 70 are stored in a waste liquid tank 74 (see FIG. 4A). As depicted in FIG. 3, the maintenance section 70 is arranged at a location which is on the right side relative to the sheet facing area and which is below the sheet facing area. The maintenance section 70 is provided with a cap 71, a tube 72 and a pump 73, as depicted in FIG. 4A.

The cap 71 is constructed of a rubber. In a case that the carriage 23 is located at a maintenance position on the right side relative to the sheet facing area, the cap 71 is located at a position at which the cap 71 faces the recording head 39 mounted on the carriage 23. The tube 72 reaches the waste liquid tank 74 from the cap 71 and via the pump 73. The pump 73 is, for example, a tube pump of a rotary system. The pump 73 is driven by the conveyance motor 102 to thereby suck the ink, etc., inside the nozzles 40 via the cap 71 and the tube 72, and to discharge the sucked ink, etc., to the waste liquid tank 74 via the tube 72.

The cap 71 is constructed, for example, to be movable between a covering position and a separate position which are separate and away in the up-down direction 7. The cap 71 located at the covering position makes tight contact with the recording head 39 mounted on the carriage 23 which is located at the maintenance position, and covers the nozzle surface. On the other hand, the cap 71 located at the separate position is separated and away from the nozzle surface. The cap 71 is movable between the covering position and the separate position by a non-illustrated ascending/descending mechanism which is driven by the feeding motor 101. Note that, however, the specific configuration for causing the cap 71 to make contact with the recording head 39 and for separating the cap 71 from the recording head 39 is not limited to the above-described example.

As another example, it is allowable that the cap 71 is moved by a non-illustrated link mechanism which operates accompanying with the movement of the carriage 23, instead of being moved by the ascending/descending mechanism driven by the feeding motor 101. The posture of the link mechanism is changeable from a first posture in which the link mechanism holds the cap 71 at the covering position, and a second posture in which the link mechanism holds the cap 71 at the separate position. For example, the link mechanism is contacted by the carriage 23 moving rightwardly toward the maintenance position and thus the posture of the link mechanism is changed from the second posture into the first posture. On the other hand, for example, the link mechanism is contacted by the carriage 23 moving leftwardly from the maintenance position and thus the posture of the link mechanism is changed from the first posture into the second posture.

As still another example, it is allowable that the multi-function peripheral 10 is provided with an ascending/descending mechanism which moves the guide rails 43 and 44 in the up-down direction 7, instead of the mechanism which moves the cap 71. Namely, the carriage 23 at the maintenance position is ascended/descended together with the guide rails 43 and 44 which are ascended/descended by the ascending/descending mechanism. On the other hand, the cap 71 is fixed to a position at which the cap 71 faces the recording head 39 mounted on the carriage 23 which is located at the maintenance position. Further, the guide rails 43 and 44 and the carriage 23 are lowered or descended to a predetermined position by the ascending/descending mechanism, thereby allowing the nozzle surface of the recording head 39 to be covered by the cap 71. On the other hand, the guide rails 43 and 44 and the carriage 23 are lifted or ascended to another predetermined position by the ascending/descending mechanism, thereby allowing the recording head 39 and the cap 71 to be separated away from each other, and allowing the carriage 23 to be movable in the main scanning direction.

As yet another example, it is allowable that the multi-function peripheral 10 is provided with both the ascending/descending mechanism which moves the cap 71 and the ascending/descending mechanism which moves the guide rails 43 and 44. Further, it is allowable that the carriage 23 and the cap 71 are moved in directions, respectively, such that the carriage 23 and the cap 71 approach closely to each other, thereby bringing the cap 71 into a tight contact with the nozzle surface. Furthermore, it is allowable that the carriage 23 and the cap 71 are moved in directions, respectively, such that the carriage 23 and the cap 71 are separated away from each other, thereby allowing the cap 71 to be separated away from the nozzle surface. Namely, the above-described covering position and separate position are each a relative position of the cap 71 relative to the recording head 39. Further, by moving one or both of the recording head 39 and the cap 71, the relative position of the cap 71 relative to the recording head 39 may be changed. In other words, by moving the recording head 39 and the cap 71 relative to each other, the relative position of the cap 71 relative to the recording head 39 may be changed.

<Cap Sensor 123>

As depicted in FIG. 6, the printer 11 is further provided with a cap sensor 123. The cap sensor 123 outputs different detection signals, depending on whether or not the cap 71 is located at the covering position. Under a condition that the cap 71 is located at the covering position, the cap sensor 123 outputs a HIGH level signal to the controller 130. On the other hand, under a condition that the cap 71 is located at a position different from the covering position, the cap sensor 123 outputs a LOW level signal to controller 130. Note that in a case that the cap 71 is moved from the covering position to the separate position, the detection signal outputted from the cap sensor 123 changes from the HIGH level signal to the LOW level signal before the cap 71 reaches the separate position.

<Ink Receiving Section 75>

As depicted in FIG. 3, the printer 11 is further provided with an ink receiving section 75. The ink receiving section 75 is arranged at a location which is on the left side relative to the sheet facing area and which is below the sheet facing area. More specifically, in a case that the carriage 23 is located on the left side relative to the sheet facing area, the ink receiving section 75 is arranged at a position at which the ink receiving section 75 faces the lower surface of the recording head 39 mounted on the carriage 23. Note that it is allowable that the maintenance section 70 and the ink receiving section 75 are arranged on a same side in the main scanning direction, with the sheet facing area as the reference. Note that, however, the maintenance section 70 and the ink receiving section 75 are arranged at positions which are separate and away from each other in the main scanning direction.

Figure 4B:
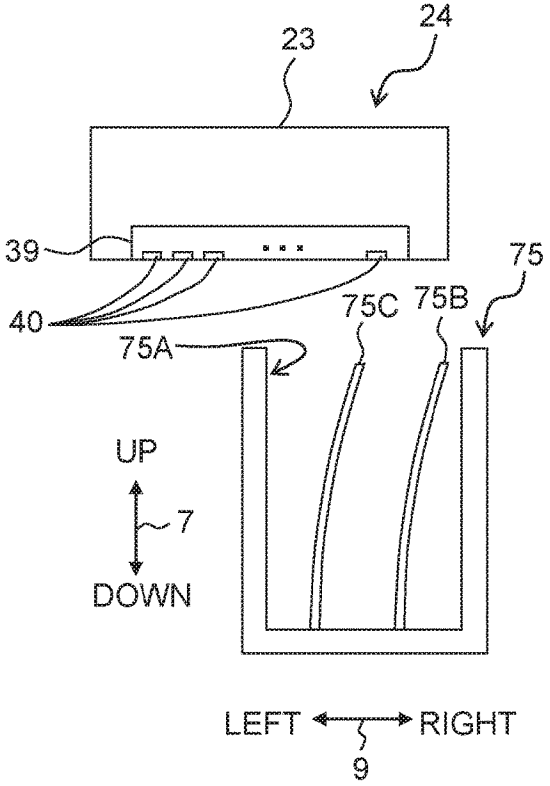
FIG. 4B is a view schematically depicting the configuration of an ink receiving section 75.
Figure 4A:
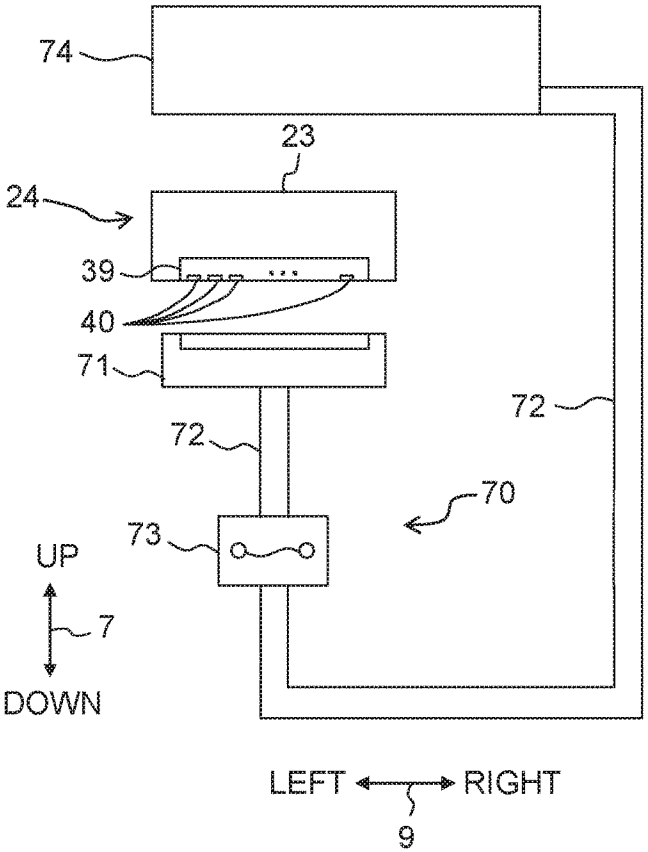
FIG. 4A is a view schematically depicting the configuration of a maintenance section 70.

As depicted in FIG. 4B, the ink receiving section 75 has a box-shape which is substantially rectangular parallelepiped and which has an opening 75A formed in the upper surface thereof. The width in the main scanning direction of the opening 75A is shorter than the width in the main scanning direction of the nozzle surface. Further, guide walls 75B and 75C each of which crosses the main scanning direction are arranged inside the ink receiving section 75, at positions apart in the left-right direction 9, respectively.

The guide walls 75B and 75C are each a plate-shaped member spreading in the up-down direction 7 and the front-rear direction 8. Further, the guide walls 75B and 75C are disposed such that each of the guide walls 75B and 75C is inclined in the left-right direction 9. More specifically, the guide walls 75B and 75C are arranged inside the ink receiving section 75 such that the left surface of each of the guide walls 75B and 75C faces (is oriented) in a left obliquely upward direction. Each of the guide walls 75B and 75C guides an ink droplet, which is jetted from the recording head 39, toward the interior or innermost surface (bottom surface) of the ink receiving section 75. Note that, however, the number of the guide walls 75B, 75C is not limited to 2 (two).

<Driving Force Transmitting Mechanism 80>

As depicted in FIG. 6, the printer 11 is further provided with a driving force transmitting mechanism 80. The driving force transmitting mechanism 80 is configured to transmit the driving forces generated by the feeding motor 101 and the conveyance motor 102 to the feeding rollers 25A, 25B, the conveyance roller 60, the discharge roller 62, the ascending/descending mechanism for the cap 71 and the pump 73. The driving force transmitting mechanism 80 is constructed by combining all or a part of: a gear, a pulley, an endless annular belt, a planetary gear mechanism (pendulum gear mechanism), a one-way clutch, and the like. Further, the driving force transmitting mechanism 80 is provided with a switching section 170 (see FIG. 5) configured to change a transmittance destination to which the driving forces generated by the feeding motor 101 and the conveyance motor 102 are transmitted.

<Switching Section 170>

Figure 5A:
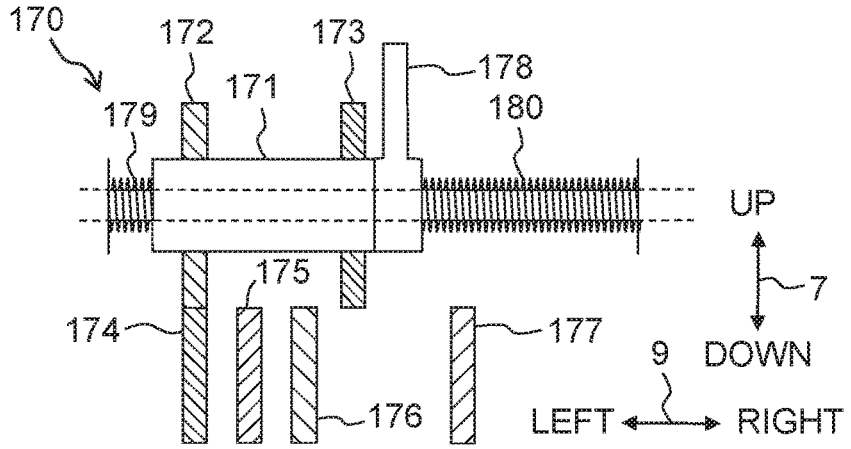
Figure 5B:
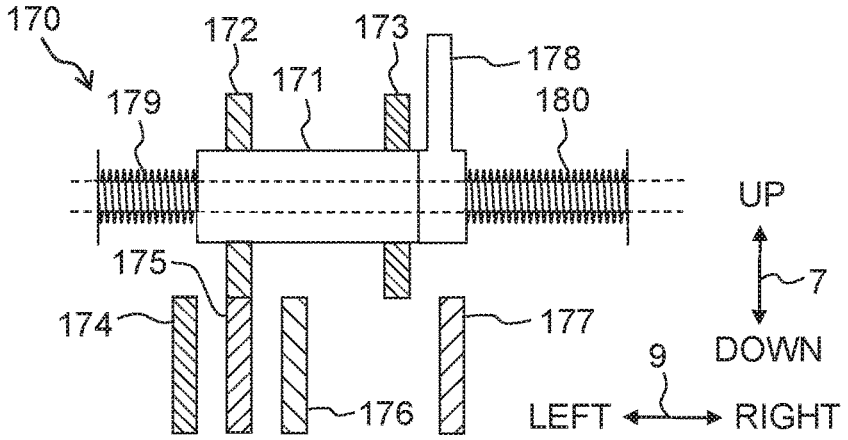
Figure 5C:
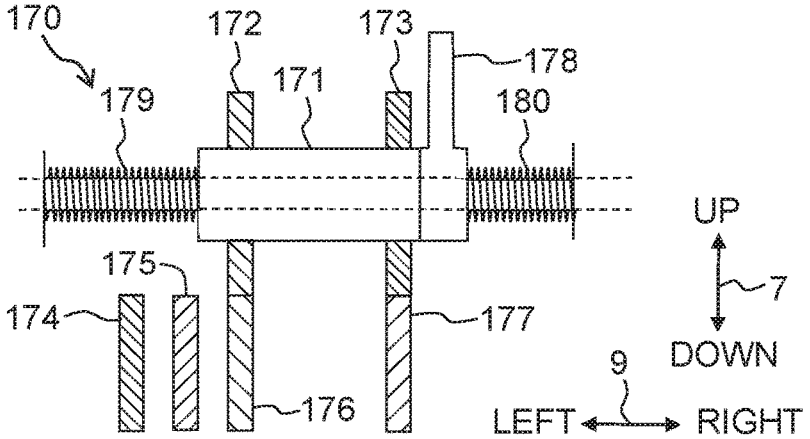

As depicted in FIG. 3, the switching section 170 is arranged on the right side from (relative to) the sheet facing area. Further, the switching section 170 is arranged at a location below the guide rail 43. Furthermore, the switching section 170 is arranged on a transmittance route of driving force from the feeding motor 101 and the conveyance motor 102 to reach the feeding rollers 25A and 25B, the ascending/descending mechanism for the cap 71, and the pump 73. As depicted in FIGS. 5A to 5C, the switching section 170 is provided with a sliding member 171, driving gears 172 and 173, gears 174, 175, 176 and 177, a lever 178 and springs 179 and 180 each of which is an example of an urging member. The switching section 170 is configured such that the state thereof is switchable to a first state, a second state and a third state. Each of the first and second states is an example of a transmitting state, and the third state is an example of a non-transmitting state.

The first state is such a state that the switching section 170 transmits the driving force of the feeding motor 101 to the feeding roller 25A, but the switching section 170 does not transmit the driving force of the feeding motor 101 to the feeding roller 25B and the ascending/descending mechanism for the cap 71. The second state is such a state that the switching section 170 transmits the driving force of the feeding motor 101 to the feeding roller 25B, but the switching section 170 does not transmit the driving force of the feeding motor 101 to the feeding roller 25A and the ascending/descending mechanism for the cap 71. The third state is such a state that the switching section 170 transmits the driving force of the feeding motor 101 to the ascending/descending mechanism for the cap 71, but the switching section 170 does not transmit the driving force of the feeding motor 101 to the feeding roller 25A and the feeding roller 25B. Further, each of the first state and the second state is also such a state that the switching section 170 transmits the driving force of the conveyance motor 102 to the conveyance roller 60 and the discharge roller 62, but the switching section 170 does not transmit the driving force of the conveyance motor 102 to the pump 73. The third state is also such a state that the switching section 170 transmits the driving force of the conveyance motor 102 to all of the conveyance roller 60, the discharge roller 62, and the pump 73.

The sliding member 171 is a substantially columnar-shaped member which is supported by a supporting shaft (indicated in broken lines in FIG. 5) extending in the left-right direction 9. Further, the sliding member 171 is configured to be slidable in the left-right direction 9 along the supporting shaft. Furthermore, the sliding member 171 supports the driving gears 172 and 173 such that the driving gears 172 and 173 are rotatable independently from each other at locations, on the outer circumferential surface of the sliding member 171, which are shifted or separated from each other in the left-right direction 9. Namely, the sliding member 171 and the driving gears 172 and 173 make a sliding movement in the left-right direction 9 integrally.

The driving gear 172 is an example of a first gear which is rotated by the rotary driving force transmitted from the feeding motor 101 to the driving gear 172. The driving gear 172 meshes with one of the gears 174, 175 and 176. More specifically, in a case that the switching section 170 is in the first state, the driving gear 172 meshes with the gear 174, as depicted in FIG. 5A. Further, in a case that the switching section 170 is in the second state, the driving gear 172 meshes with the gear 175, as depicted in FIG. 5B. Furthermore, in a case that the switching section 170 is in the third state, the driving gear 172 meshes with the gear 176, as depicted in FIG. 5C. A position at which the driving gear 172 is located, as depicted in FIG. 5A, is an example of the first position; a position at which the driving gear 172 is located, as depicted in FIG. 5B, is an example of the third position; and a position at which the driving gear 172 is located, as depicted in FIG. 5C, is an example of the second position.

The driving gear 173 is rotated by the rotary driving force transmitted from the conveyance motor 102 to the driving gear 173. In a case that the state of the switching section 170 is either one of the first state and the second state, the meshing of the driving gear 173 with the gear 177 is released, as depicted in FIGS. 5A and 5B. Further, in a case that the state of the switching section 170 is the third state, the driving gear 173 meshes with the gear 177, as depicted in FIG. 5C.

The gear 174 is an example of a second gear which meshes with a gear train rotating the feeding roller 25A. Namely, the rotary driving force of the feeding motor 101 is transmitted to the feeding roller 25A by the meshing of the driving gear 172 with the gear 174. Further, the rotary driving force of the feeding motor 101 is not transmitted to the feeding roller 25A due to the release of meshing of the driving gear 172 with the gear 174.

The gear 175 is an example of a fourth gear which meshes with a gear train rotating the feeding roller 25B. Namely, the rotary driving force of the feeding motor 101 is transmitted to the feeding roller 25B by the meshing of the driving gear 172 with the gear 175. Further, the rotary driving force of the feeding motor 101 is not transmitted to the feeding roller 25B due to the release of meshing of the driving gear 172 with the gear 175.

The gear 176 is an example of a third gear which meshes with a gear train driving the ascending/descending mechanism for the cap 71. Namely, the rotary driving force of the feeding motor 101 is transmitted to the ascending/descending mechanism for the cap 71 by the meshing of the driving gear 172 with the gear 176. Further, the rotary driving force of the feeding motor 101 is not transmitted to the ascending/descending mechanism for the cap 71 due to the release of meshing of the driving gear 172 with the gear 176.

The gear 177 meshes with a gear train driving the pump 73. Namely, the rotary driving force of the conveyance motor 102 is transmitted to the pump 73 by the meshing of the driving gear 173 with the gear 177. Further, the rotary driving force of the conveyance motor 102 is not transmitted to the pump 73 due to the release of meshing of the driving gear 173 with the gear 177. On the other hand, the rotary driving force of the conveyance motor 102 is transmitted to the conveyance roller 60 and the discharge roller 62 not via the switching section 170. Namely, the conveyance roller 60 and the discharge roller 62 are rotated by the rotary driving force transmitted thereto from the conveyance motor 102, regardless of the state of the switching section 170.

The lever 178 is an example of a holding member which is supported by the supporting shaft at a location adjacent to a right side portion of the sliding member 171. Further, the lever 178 is configured to be slidable in the left-right direction 9 along the supporting shaft. Furthermore, the lever 178 is projected upwardly. Moreover, a forward end (tip portion) of the lever 178 reaches up to a position at which the forward end is capable of contacting with the carriage 23, via an opening 43A (see FIG. 3) formed in the guide rail 43. The lever 178 is configured to be slidable in the left-right direction 9 by being contacted by the carriage 23 and by being separated from the carriage 23. Further, the switching section 170 is provided with a plurality of locking sections configured to lock the lever 178. Accordingly, the lever 178, in a state of being locked by a locking section among the plurality of locking sections and then being separated from the carriage 23 at a certain location, may remain at the certain location even after the lever 178 has been separated away from the carriage 23.

The springs 179 and 180 are supported by the supporting shaft. The spring 179 makes contact with the frame of the printer 11 at one end (left end) of the spring 179, and the spring 179 makes contact with the left end surface of the sliding member 171 at the other end (right end) of the spring 179. Namely, the spring 179 urges the sliding member 171 and the lever 178 contacting the sliding member 171 rightwardly. The spring 180 makes contact with the frame of the printer 11 at one end (right end) of the spring 180, and the spring 180 makes contact with the right end surface of the lever 178 at the other end (left end) of the spring 180. Namely, the spring 180 urges the lever 178 and the sliding member 171 contacting the lever 178 leftwardly. Further, the urging force of the spring 180 is greater than the urging force of the spring 179.

In a case that the lever 178 is locked by a first locking section included in the plurality of locking sections, the switching section 170 is in the first state. Then, the lever 178, pushed or pressed by the carriage 23 moving rightwardly, moves rightwardly against the urging force of the spring 180, and is locked by a second locking section located on the right side with respect to the first locking section. With this, the sliding member 171 moves rightwardly, by the urging force of the spring 179, following the movement of the lever 178. As a result, the state of the switching section 170 is changed from the first state depicted in FIG. 5A to the second state depicted in FIG. 5B. Namely, the lever 178 is contacted by the carriage 23 which is moving rightwardly toward the maintenance position to thereby switch the state of the switching section 170 from the first state into the second state.

Further, the lever 178, pressed by the carriage 23 moving rightwardly toward (or up to) the maintenance position, moves rightwardly against the urging force of the spring 180, and is locked by a third locking section located farther on the right side with respect to the second locking section. With this, the sliding member 171 moves rightwardly, by the urging force of the spring 179, following the movement of the lever 178. As a result, the state of the switching section 170 is changed from the first state depicted in FIG. 5A or the second state depicted in FIG. 5B to the third state depicted in FIG. 5C. Namely, the lever 178 is contacted by the carriage 23 which is moving rightwardly toward the maintenance position to thereby switch the state of the switching section 170 into the third state.

Furthermore, the lever 178, pressed by the carriage 23 moving farther rightwardly from the maintenance position and then separated away from the carriage 23 moving leftwardly, is released from the locking by the third locking section. With this, the sliding member 171 and the lever 178 are moved leftwardly by the urging force of the spring 180. Then, the lever 178 is locked by the first locking section. As a result, the state of the switching section 170 is changed from the third state depicted in FIG. 5C to the first state depicted in FIG. 5A. Namely, the lever 178 is separated from the carriage 23 which is moving leftwardly from the maintenance position to thereby switch the state of the switching section 170 from the third state into the first state.

Namely, the state of the switching section 170 is switched by the contact and separation of the carriage 23 with respect to the lever 178. In other words, the transmittance destinations of the driving forces of the feeding motor 101 and the conveyance motor 102 are switched by the carriage 23. A state that the lever 178 is locked by the third locking section is an example of a holding state in which the lever 178 holds the driving gear 172 at the second position against urging forces of the springs 179 and 180. A state in which the lever 178 is not locked by the third locking section is an example of an allowing section in which the lever 178 allows the driving gear 172 to move. Note that the state of the switching section 170 according to the present embodiment is not switched directly from the third state to the second state; rather, the state of the switching section 170 is required to be switched from the third state to the first state, then further switched from the first state to the second state, as described above.

<Electric Power Supply 110>

The multi-function peripheral 10 has the electric power supply 110, as depicted in FIG. 6. The electric power supply 110 has a variety of kinds of electronic circuits configured to supply the electric power, supplied thereto from an external power supply via a power plug, to the respective constituent components, parts, etc., of the multi-function peripheral 10. More specifically, the electric power supply 110 outputs the electric power obtained from the external power supply as a driving voltage (for example, 24V) to the respective motors 101 to 103 and the recording head 39, and outputs the electric power as a controlling voltage (for example, 5V) to the controller 130.

Further, the electric power supply 110 is capable of being switched (switchable) between a driving state and a sleeping state, based on a power signal outputted from the controller 130. More specifically, the controller 130 outputs a HIGH level power signal (for example, 5V) to thereby switch the electric power supply 110 from the sleeping state to the driving state. On the other hand, the controller 130 outputs a LOW level power signal (for example, 0V) to thereby switch the electric power supply 110 from the driving state to the sleeping state.

The term "driving state" means a state in which the driving voltage is outputted to the motors 101 to 103 and to the recording head 39. In other words, the driving state means a state in which the motors 101 to 103 and the recording head 39 are each in an operable state or an active state. The term "sleeping state" means a state in which the driving voltage is not outputted to the motors 101 to 103 and to the recording head 39. In other words, the sleeping state means a state in which the motors 101 to 103 and the recording head 39 are each in an inoperative state or an inactive state. Although not depicted in the drawings, the electric power supply 110 outputs the controlling voltage to the controller 130 and a communicating section 50 (see FIG. 6), regardless of whether the electric power supply 110 is in the driving state or in the sleeping sate.

<Controller 130>

As depicted in FIG. 6, the controller 130 is provided with a CPU 131, a ROM 132, a RAM 133, an EEPROM 134 and an ASIC 135 which are connected to one another by an internal bus 137. The ROM 132 stores various programs which are executed by the CPU 131 to thereby control a variety of kinds of operations. The RAM 133 is used as a storage area for temporarily storing a data and/or signal, etc., to be used when the CPU 131 executes the program(s), or as a working area for data processing. The EEPROM 134 is an example of a memory which stores setting information which should be retained even after the power supply of the multi-function peripheral 10 is switched off.

The feeding motor 101, the conveyance motor 102 and the carriage motor 103 are connected to the ASIC 135. The ASIC 135 generates a driving signal for rotating each of the motors, and outputs the generated driving signal to each of the motors. Each of the motors is driven to rotate in the normal direction or in the reverse direction, in accordance with the driving signal from the ASIC 135. Further, the controller 130 applies the driving voltage of the electric power supply 110 to the driving elements, via a non-illustrated driver IC of the recording head 39, to thereby cause the ink droplets to be jetted or discharged from the nozzles 40 corresponding to the driving elements, respectively.

Further, the communicating section 50 is connected to the ASIC 135. The communicating section 50 is a communicating interface capable of communicating with an information processing apparatus 51 as an example of an external apparatus. Namely, the controller 130 transmits or sends a variety of kinds of information to the information processing apparatus 51 via the communicating section 50, and receives or accepts a variety of kinds of information from the information processing apparatus 51 via the communicating section 50. The communicating section 50 may be, for example, configured to transmit and receive a radio signal by a communication protocol in accordance with Wi-Fi (trade name by Wi-Fi Alliance), or may be an interface to which a LAN cable or a USB cable is connected. Note that in FIG. 6, the information processing apparatus 51 is surrounded by a frame drawn with a broken line so as to distinguish the information processing apparatus 51 from the constituents of the multi-function peripheral 10.

Further, the registration sensor 120, the rotary encoder 121, the carriage sensor 38, the media sensor 122 and the cap sensor 123 are connected to the ASIC 135. The controller 130 detects the position of the sheet 12 based on the detection signal outputted from the registration sensor 120 and the pulse signal outputted from the rotary encoder 121. Further, the controller 130 detects the position of the carriage 23 based on the pulse signal outputted from the carriage sensor 38. Furthermore, the controller 130 detects the position of the cap 71 based on the detection signal outputted from the cap sensor 123.

Moreover, the controller 130 detects the sheet 12 conveyed by the conveyance roller section 54 and the discharge roller section 55 based on the detection signal outputted from the media sensor 122. More specifically, the controller 130 compares an amount of change (change amount) in signal level between detection signals, which are temporarily adjacent, with a predetermined threshold value. Further, in response to that (under a condition that) the change amount in the signal level becomes to be not less than the threshold value, the controller 130 detects that a forward end or a tip end of the sheet 12 has reached a position at which the forward end faces the media sensor 122 in the up-down direction 7.

Further, the EEPROM 134 stores number-of-times information. The number-of-times information is information indicating a number of error (number of times of occurrence of error) in each of which the sheet 12 cannot (could not) be conveyed up to the position of the registration sensor 120 in a feeding processing (step S26; to be described later on). More specifically, the number-of-times information indicates a number of times in each of which the registration sensor 120 does not detect (has not detected) the sheet 12 in the feeding processing (hereinafter referred to as a "feeding error"). At a time of shipment of the multi-function peripheral 10, an initial value (=0) is set in the number-of-times information, and the number-of-times information is incremented every time the feeding error newly occurs. Namely, the number-of-times information indicates a cumulative number of times of occurrence of the feeding error in the multi-function peripheral 10.

<Image Recording Processing>

Next, an explanation will be given about an image recording processing of the present embodiment, with reference to FIGS. 7A, 7B, 8A and 8B. In response to that the multi-function peripheral 10 receives a command from the information processing apparatus 51 via the communicating section 50, the multi-function peripheral 10 starts the image recording processing. The command received from the information processing apparatus 51 is an example of an image recording instruction for recording an image on a sheet.

Note that at a time of starting the image recording processing, it is assumed that the carriage 23 is located at the maintenance position, the cap 71 is located at the covering position, and the switching mechanism 170 is in the third state. The respective processing to be described below may be executed such that the CPU 131 reads out the program stored in the ROM 132 and executes the read program, or may be executed by a hardware circuit mounted on the controller 130. Note that the order of execution of the respective processings may be appropriately changed, without departing from the gist and/or scope of the present teaching.

Firstly, although not depicted in the drawings, under a condition for example that the information processing apparatus 51 receives, from a user, a command for causing the multi-peripheral 10 to execute the image recording processing, the information processing apparatus 51 transmits a preceding command to the multi-function peripheral 10. The preceding command is a command previously announcing transmittance of a recording command (to be described later on). Next, under a condition that the information processing apparatus 51 has transmitted the preceding command, the information processing apparatus 51 generates a raster data from an image data designated by the user. Then, under a condition that the information processing apparatus 51 has generated the raster data, the information processing apparatus 51 transmits the recording command to the multi-function peripheral 10. The recording command is a command causing an image indicated by the raster data to be recorded on a sheet.

Figure 7A:
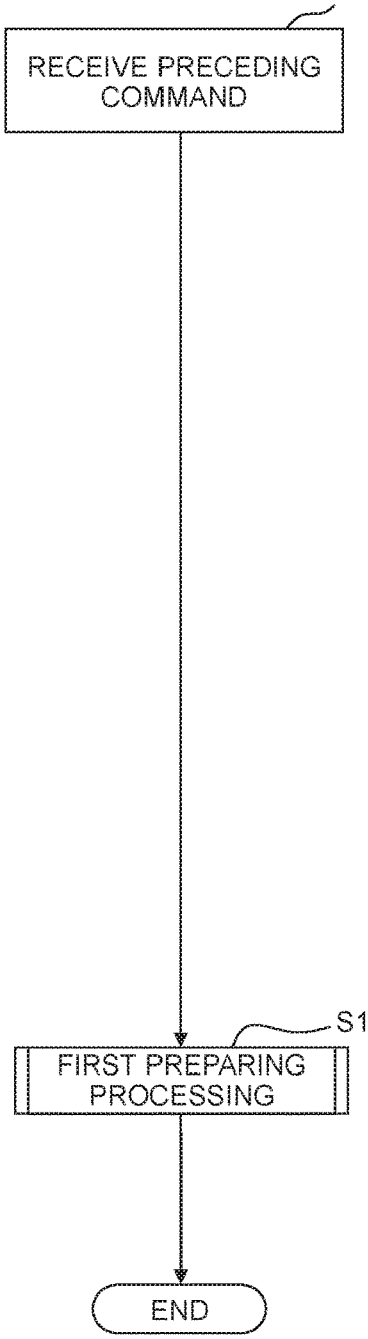
FIGS. 7A and 7B are each a flow chart of an image recording processing.
Figure 8A:
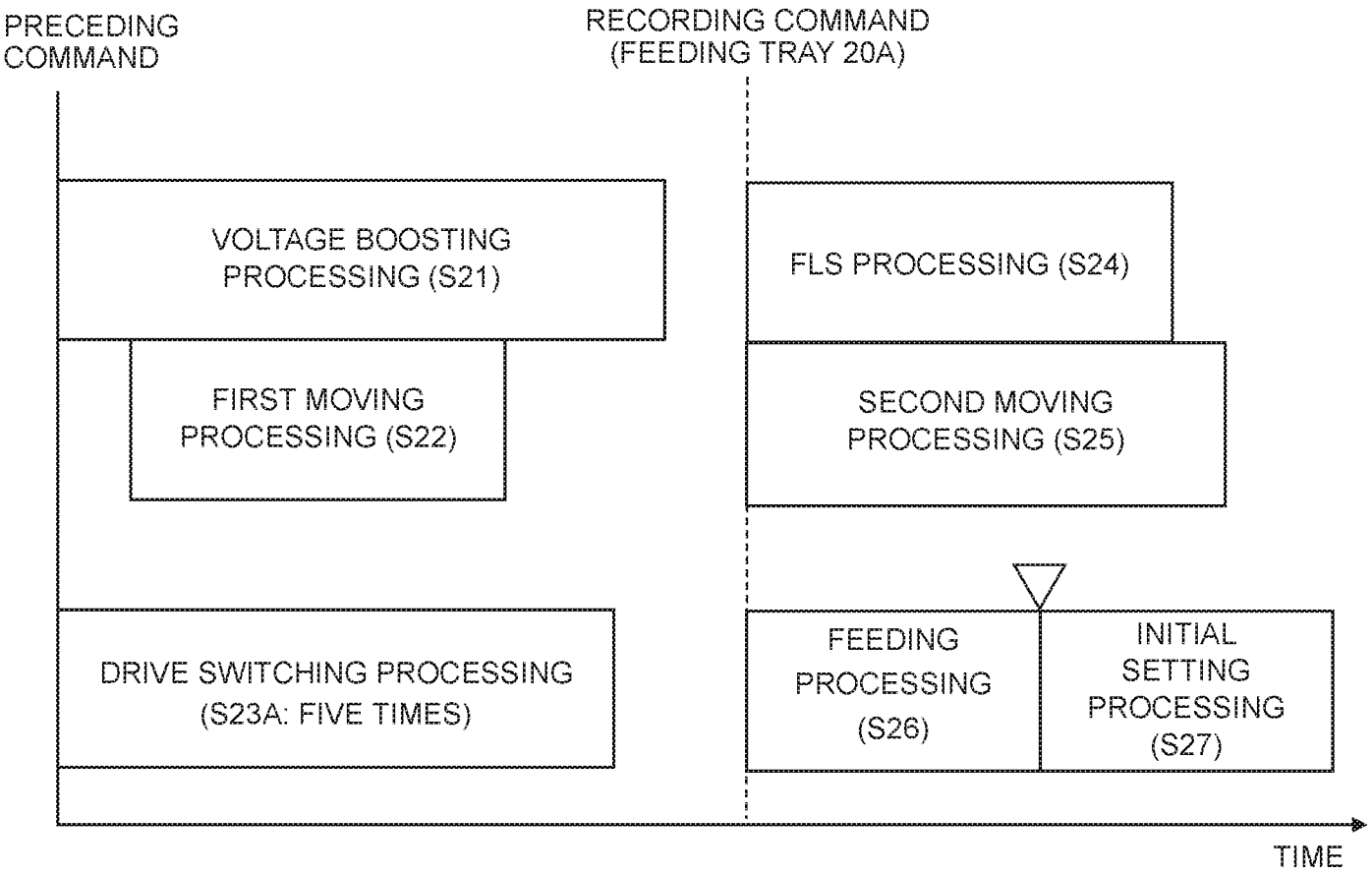
FIGS. 8A and 8B are each a timing chart depicting an execution timing for a preparing processing, wherein FIG. 8A indicates an example in which a recording command is received after completion of a first preparing processing, and FIG. 8B indicates an example in which the recording command is received while the first preparing processing is being executed.
Figure 8B:
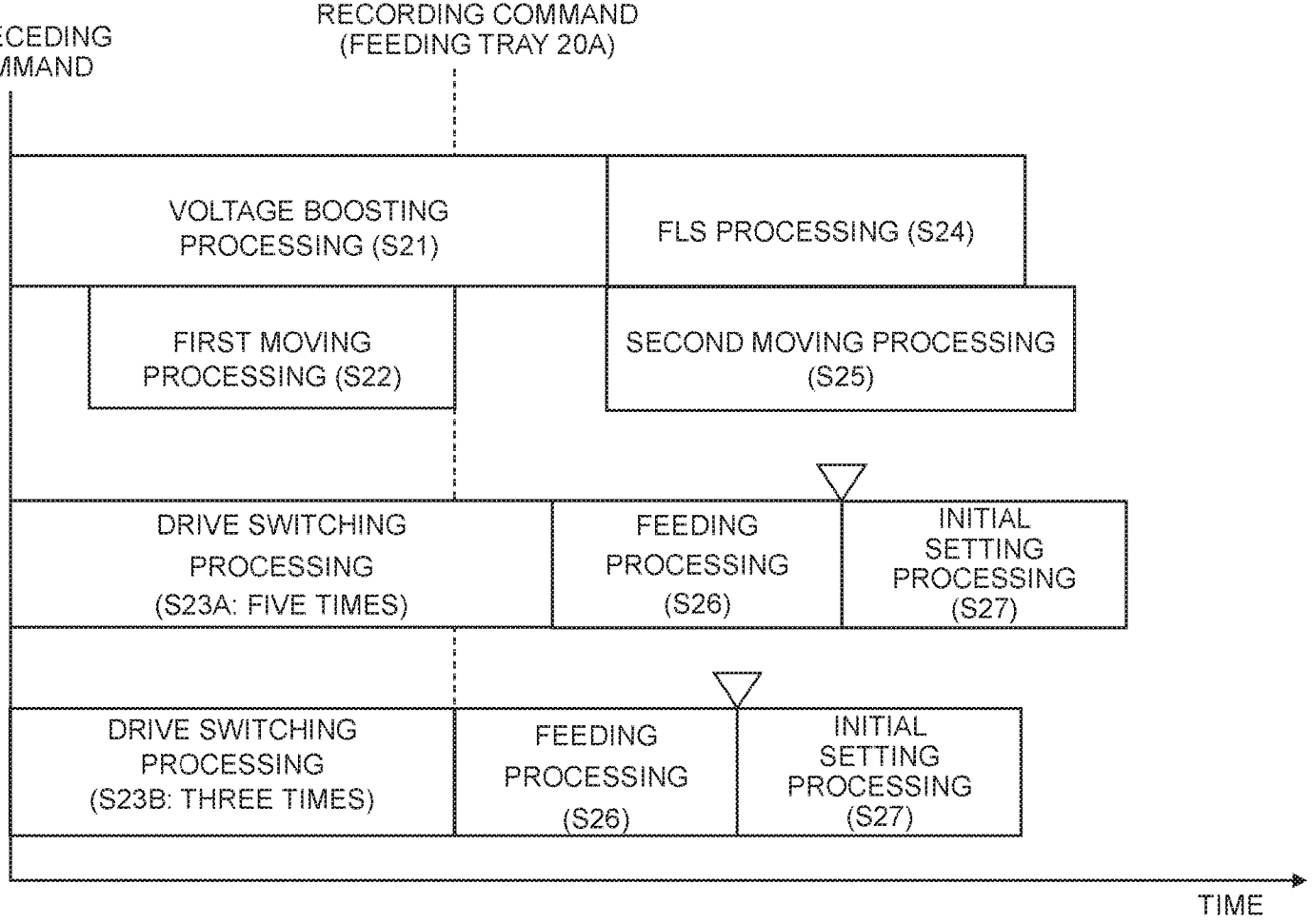

As depicted in FIG. 7A, under a condition that the preceding command has been received by the controller 130 of the multi-function peripheral 10 from the information processing apparatus 51 via the communicating section 50 (S10), the controller 130 executes a first preparing processing (S12). Namely, the preceding command can be rephrased as a command for instructing the execution of the first preparing processing. The first preparing processing is a processing for allowing the printer 11 to be in a state that the recording processing can be executed. The phrase that "the state that the recording processing can be executed" can be rephrased as, for example, a state that an image can be recorded with a quality of not less than a predetermined level. The first preparing processing includes, for example, a voltage boosting processing (S21), a first moving processing (SS22), and a drive switching processing (S23A, S23B), as depicted in FIGS. 8A and 8B.

The voltage boosting processing (S21) is a processing for boosting (raising) the driving voltage, which is to be supplied by the electric power supply 110 to the respective elements of the printer 11, to a target voltage value $V_T$ (for example, 24V). The electric power supply 110 boosts, for example, the power supply voltage, supplied from the external power supply, to the target voltage value $V_T$ with a non-illustrated regulator circuit. Boosting the voltage of the electric power supply 110 means, for example, storing the charge in a power storage element such as a non-illustrated condenser, etc. Further, in a case that the charge corresponding to the target voltage value $V_T$ has been stored in the power storage element, then the regulator circuit continuously applies the voltage for maintaining the driving voltage to the power storage element.

The first moving processing (S22) is a processing for moving the carriage 23, which has been separated away from the cap 71, to a flushing position located on the left side with respect to the ink receiving section 75. More specifically, the controller 130 causes the carriage 23 at the maintenance position to move rightwardly, and then to move leftwardly until the carriage 23 reaches the flushing position. Further, in order to suppress any destruction of the meniscus of the ink formed in the nozzles 40 of the recording head 39, it is allowable that the controller 130 causes the carriage 23 to move leftwardly at a low speed or velocity at the time at which the processing of step S22 is started, and then the controller 130 executes the processing of step S22.

The drive switching processing (S23) includes a processing for moving the cap 71 from the covering position to the separate position, and a processing for switching the state of the switching section 170 from the third state to the first state. Namely, the controller 130 rotates the feeding motor 101 just by a predetermined rotational amount. Then, by allowing the rotary driving force of the feeding motor 101 to be transmitted to the ascending/descending mechanism (for the cap 71) via the switching section 170 in the third state, the cap 71 is moved from the covering position to the separate position.

Further, by the movement of the carriage 23 rightwardly from the maintenance position in the first moving processing, the locking of the lever 178 by the third locking section is released (namely, the switching from the holding state into the allowing state is executed). With this, the sliding member 171, the driving gears 172 and 173 and the lever 178 are moved leftwardly by the urging force of the spring 180. Namely, the driving gear 172 is separated away from the gear 176, climbs over (passes over) the gear 175, and meshes with the gear 174. Further, the driving gear 173 is separated away from the gear 177. Namely, the state of the drive switching section 170 is switched from the non-transmitting state into the transmitting state.

Then, the controller 130 causes both of the feeding motor 101 and the conveyance motor 102 to perform the clockwise and counterclockwise rotations slightly (a little at a time) (hereinafter referred to as a "jiggling"), in a process during which the driving gears 172 and 173 are moved leftwardly. The jiggling is, for example, an operation for causing the feeding motor 101 and the conveyance motor 102 to perform the normal rotation or the reverse rotation just by a predetermined rotational amount, and then causing both of the feeding motor 101 and the conveyance motor 102 to perform the reverse rotation or the normal rotation just by the predetermined rotational amount. The rotation amounts of the feeding motor 101 and the conveyance motor 102 are, for example, angles required for rotating the gears 172 and 173, respectively, each by not less than ½ of the width of a tooth in the circumferential direction thereof (by not less than ½ of the circumferential thickness of the tooth thereof) (more preferably, by not less than the width of the tooth in the circumferential direction thereof).

The controller 130 executes the jiggling maximally five times with a predetermined interval, in response to the starting of the leftward movement of the carriage 23 in the first moving processing. With this, since the bearing stress between the driving gear 172 and the gear 176 and the bearing stress between the driving gear 173 and the gear 177 are released, the meshings among the respective gears can be released smoothly. Further, the driving gear 172 can smoothly climb (pass) over the gear 175, and can mesh smoothly with the gear 174.

Note that as depicted in FIGS. 8A and 8B, the controller 130 executes the processings of steps S21 to S23 in parallel. More specifically, the controller 130 starts the processing of step S21 and the processing of step S23 at the same time at a timing at which the controller 130 receives the preceding command. Further, the controller 130 starts the processing of step S22 at a timing at which the detection signal from the cap sensor 123 is changed from the HIGH level signal to the LOW level signal. Namely, the controller 130 starts the processing of step S22 after starting the steps S21 and S23.

Figure 7B:
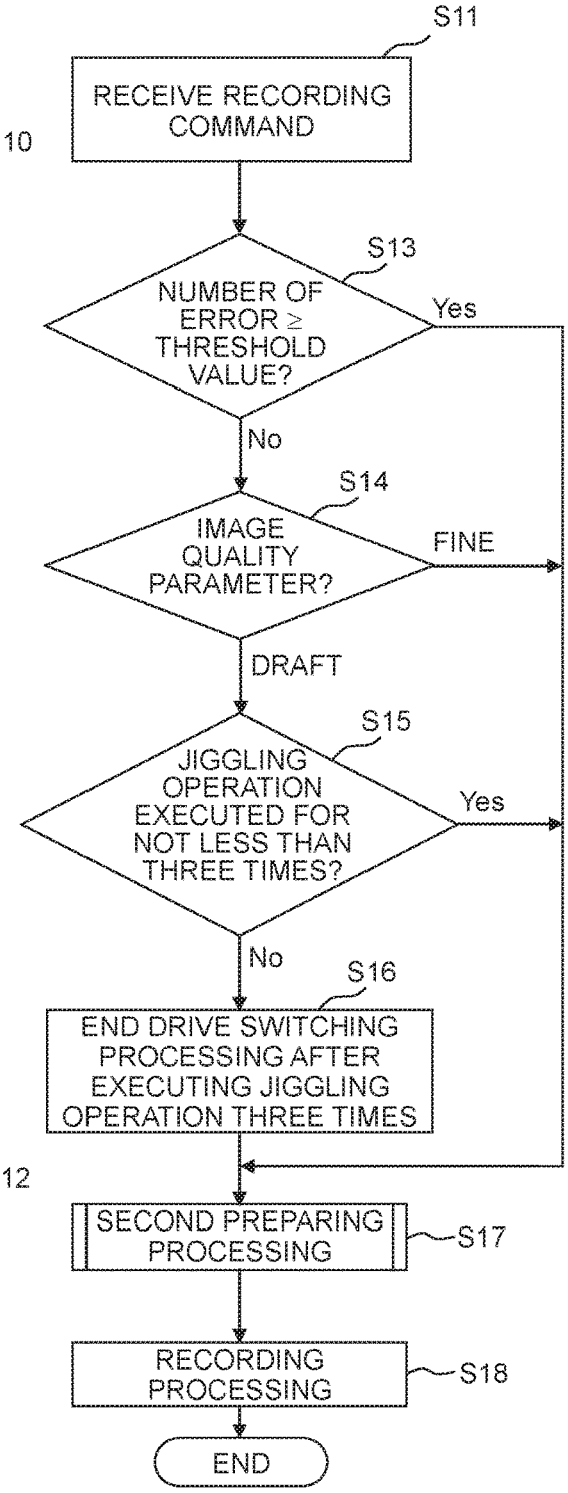

As depicted in FIG. 7B, in response to receipt of the recording command from the information processing apparatus 51 via the communicating section 50 (S11), the controller 130 determines whether or not the number of error (number of times of occurrence of error) indicated by the number-of-times information of the EEPROM 134 is not less than a threshold value (for example, three times). In other words, the controller 130 determines whether or not the cumulative number of the feeding error has reached a predetermined number of times. The processing of step S13 is an example of a second determining processing. Note that at a time of the receipt of the recording command, there is such a possibility that the first preparing processing (steps S21 to S23) has already completed, as depicted in FIG. 8A, or there is such a possibility that the first preparing processing (S21 to S23) is still being executed, as depicted in FIG. 8B.

Next, in response to determination made by the controller 130 that the number of error is less than the threshold value (S13: No), the controller 130 determines the setting value of an execution parameter included in the obtained image recording command (S14). The execution parameter is information indicating an execution condition of a recording processing which will be described later on. In the execution parameter, for example, a value which is designated (specified) by the user instructing the image recording via the information processing apparatus 51 is set. The execution parameter according to the present embodiment includes an image quality parameter indicating the resolution of an image to be recorded on the sheet 12. In the image quality parameter, a first value "Fine" or a second value "Draft" are set. The processing in step S14 is an example of a first determining processing.

The first value "Fine" of the image quality parameter indicates a resolution higher than that indicated by the second value "Draft". In other words, a recording processing executed in accordance with the image quality parameter in which the first value "Fine" is set has an amount of the ink, to be landed on the sheet 12 per unit area of the sheet 12, which is larger as compared with a recording processing executed in accordance with the image quality parameter in which the second value "Draft" is set. Further in other words, the recording processing executed in accordance with the image quality parameter in which the first value "Fine" is set has an execution time of the recording processing which is longer as compared with the recording processing executed in accordance with the image quality parameter in which the second value "Draft" is set.

However, the specific example of the execution parameter is not limited to or restricted by the image quality parameter; the specific example of the execution parameter may include, for example:

the kind of the sheet 12 on which the image is to be recorded (in other words, the kind of the sheet 12 supported by the feed tray 20A or 20B; for example, the first value: "Glossy Paper sheet" and the second value: "Plain Paper sheet");

whether or not the ink is to be allowed to land on an outer edge of the sheet 12 (for example, the first value: "Without Margin", and the second value: "With Margin";

whether or not an image is to be recorded on both surfaces of the sheet 12 (for example, the first value: "Both Surfaces (Sides)", and the second value: "One Surface (Single Side)"; and the format of data indicating the image to be recorded on the sheet 12 (in other words, the format of the data included in the recording command; for example, the first value: "Image Format (JPEG/TIFF), and the second value: "Document Format (txt/doc)"); and the like. Note that in all the specific examples of the execution parameter as indicated above, the second value is a value with which the execution time of the recording processing becomes shorter than the first value.

Next, in response to determination made by the controller 130 that the second value "Draft" is set in the image quality parameter (S14: Draft), the controller 130 determines as to whether or not a number of times of the execution of the jiggling started in step S23 is already not less than three times (S15). The processing in step S15 is an example of a third determining processing. Then, in response to determination made by the controller 130 that the number of times of the execution of the jiggling at the time of receipt of the recording command is less than three time (S15: No), the controller 130 ends the drive switching processing at a point of time at which the controller 130 has executed the jiggling three times (S16), and executes a second preparing processing (S17).

On the other hand, in response to determination made by the controller 130 that the number of times of the execution of the jiggling at the time of receipt of the recording command is not less than three time (S15: Yes), the controller 130 executes the jiggling five times and then executes the second preparing processing (S17). Further, in response to determination made by the controller 130 that the first value "Fine" is set in the image quality parameter (S14:

Fine), the controller 130 executes the jiggling five times, without executing the processings of steps S15 and S16, and then executes the second preparing processing (S17). Further, in response to determination made by the controller 130 that the number of error is not less than the threshold value (S13: Yes), the controller 130 executes the jiggling five times, without executing the processings of steps S14 to S16, and then executes the second preparing processing (S17).

Namely, as depicted in FIG. 8A, in a case that the time interval since the receipt of the preceding command and until the receipt of the recording command is long, the controller 130 executes the jiggling five times in the drive switching processing (S23A). On the other hand, as depicted in FIG. 8B, in a case that the time interval since the receipt of the preceding command and until the receipt of the recording command is short, the controller 130 switches the number of times of execution of the jiggling depending on the result of determination in each of steps S13 to S15. The "five times" is an example of a first number of times, and the "three times" is an example of a second number of times.

The second preparing processing is a processing which is not included in the first processing, among the processing for allowing the printer 11 to be in the state that the recording processing can be executed. The second preparing processing includes, for example, a FLS (flushing) processing (S24), a second moving processing (S25), a feeding processing (S26) and a positioning processing (initial setting processing, cue-feeding processing) (S27), as depicted in FIGS. 8A and 8B.

The FLS (flushing) processing (S24) is a processing for causing the ink droplets to be discharged from the respective nozzles 40 toward the ink receiving section 75, during a process of causing the carriage 23 to move rightwardly in the second moving processing. Namely, the controller 130 applies the driving voltage, which has been boosted to the target voltage value in the voltage boosting processing (S21), to each of the driving elements which corresponds to one of the nozzles 40, at discharge timings predetermined for the nozzles 40, respectively, thereby causing the ink to be discharged from all the nozzles 40.

An ink droplet jetting timing at which the ink droplets are jetted in the FLS processing is previously determined such that the ink droplets are allowed to land on the guide walls 75B and 75C. The jetting timing for each of the nozzles 40 is specified, for example, based the encoder value of the carriage sensor 38. In the present embodiment, at an initial timing, ink droplets are jetted from nozzle arrays on the right end and configured to jet the black ink and from nozzle arrays which are adjacent to the nozzle arrays, on the right end and configured to jet the black ink, and which are configured to jet the yellow ink; and then at a next timing, ink droplets are jetted from two groups of nozzle arrays located to be immediate left of the nozzle arrays from which the ink droplets of the black ink and the yellow inks have been jetted at the first timing. Namely, the controller 130 causes the ink droplets from each of the nozzles 40 in the nozzle arrangement order in the main scanning direction (namely, in an order from right to left).

The second moving processing (S25) is a processing for moving the carriage 23 rightwardly toward a detection position. Namely, the controller 130 drives the carriage motor 103 to thereby cause the carriage 23 rightwardly up to the detection position. The term "detection position" means a position which is located at the sheet facing area and at which the carriage 23 is capable of facing a sheet 12 of each of all the sizes (for example, A4, B4, L-size, etc.) supportable by the feed trays 20A and 20B. In a case that the sheet 12 is supported by the feed tray 20A or 20B in a state that the center in the main scanning direction of the sheet 12 is positioned with respect to the feed tray 20A or 20B, the detection position may be located at the center in the main scanning direction of the sheet facing area.

The feeding processing (S26) is a processing for causing the feeding section 15A to feed a sheet 12, supported by the feed tray 20A, up to a position at which the sheet 12 reaches the conveyance roller section 54. This feeding processing is executed in a case that the recording command indicates the feed tray 20A as the feeding source from where the sheet 12 is fed. The controller 130 causes the feeding motor 101 to rotate normally, and causes the feeding motor 101 to further rotate normally just by a predetermined rotation amount after the detection signal of the registration sensor 120 is changed from the LOW level signal to the HIGH level signal. Further, by the transmittance of the rotary driving force of the feeding motor 101 to the feeding roller 25A via the switching section 170 in the first state, the sheet 12 supported by the feed tray 20A is fed to the conveyance route 65.

On the other hand, in response to such a situation that the detection signal of the registration sensor 120 is not changed from the LOW level signal to the HIGH level signal even though the feeding motor is normally rotated by the predetermined rotational amount in the feeding processing, the controller 130 increments, just by one, the number of error indicated by the number-of-time information of the EEPROM. Further, the controller 130 may make a report of the occurrence of feeding error via a non-illustrated reporting section (for example, a display, a LED, a speaker, etc.).

The initial setting processing (cue-feeding processing) (S27) is a processing for causing the conveyance roller section 54 and the discharge roller section 55 to convey, in the conveyance direction 16, the sheet 12, which has been conveyed by the feeding processing and has reached the conveyance roller section 54, up to a facing position at which an area, of the sheet 12, in which an image is to be recorded first (hereinafter referred also to as a "recording area" or "initial recording area" in some cases) may face the recording head 39. The initial recording area on the sheet 12 is indicated in the recording command. The controller 130 causes the conveyance motor 102 to rotate normally to thereby cause the conveyance roller section 54 and the discharge roller section 55 to convey the sheet 12, which has reached the conveyance roller section 54, until the initial recording area indicated by the recording command faces the recording head 39. Further, the controller 130 uses the media sensor 122 to detect the forward end of the sheet 12 during the process in which the initial setting processing is being executed. The processing in step S26 and the processing in step S27 are an example of the initial conveying processing.

Note that the processings S24 to S27 cannot be started unless at least a portion of the processings S21 to S23 has been already completed. More specifically, the second moving processing cannot be started unless the voltage boosting processing and the first moving processing have been already completed, but can be started even if the drive switching processing has not been completed yet. Further, the FLS processing cannot be started unless the second moving processing has been started. Furthermore, the feeding processing cannot be started unless the drive switching processing has been already completed, but can be started even if the voltage boosting processing and the first moving processing have not been completed yet. Moreover, the initial setting processing cannot be started unless the feeding processing has been already completed.

Namely, in response to the completion of the voltage boosting processing and the first moving processing, the controller 130 starts the second moving processing. Then, after the controller 130 has started the second moving processing, the controller 130 starts the FLS processing. Namely, the controller 130 executes the second moving processing in parallel with the FLS processing. Furthermore, in response to the completion of the drive switching processing, the controller 130 starts the feeding processing. Then, in responses to the completion of the feeding processing, the controller 130 starts the initial setting processing.

Further, although not depicted in the drawings, in a case that the recording command indicates the feed tray 20B as the feeding source from where the sheet 12 is fed and in response to the completion of the FLS processing, the controller 130 switches the state of the switching section 170 from the first state to the second state. Namely, the controller 130 causes the carriage 23 which is being moved in the second moving processing to further move rightwardly, and causes the lever 178 which has been locked by the first locking section to be locked by the second locking section. Further, in response to the switching of the switching section 170 into the second state, the controller 130 causes the carriage 23 to move leftwardly toward the detection position. Then, in response to the switching of the switching section 170 into the second state, the controller 130 starts the feeding processing for feeding the sheet 12 supported by the feed tray 20B.

Next, in response to the completion of all the processings included in the second preparing processing, the controller 130 executes the recording processing in accordance with the received recording command (S18). In other words, in response to the detection of the sheet 12 by the controller 130 via the media sensor 122 during the initial setting processing and in response to the completion of the initial setting processing by the controller 130, the controller 130 executes the recording processing. The recording processing includes, for example, a jetting processing and a conveying processing which are executed alternately, and a discharging processing. The jetting processing is a processing for causing the recording head 39 to jet ink droplets selectively, in accordance with the recording command, with respect to the recording area of the sheet 12 which is made to face the recording head 39. The conveying processing is a processing for causing the conveyance roller section 54 and the discharge roller section 55 to convey the sheet 12 only (just) by an amount corresponding to a predetermined conveyance width along the conveyance direction 16. The discharging processing is a processing for causing the discharge roller section 55 to discharge the sheet 12, having an image recorded thereon, to the discharge tray 21.

Namely, the controller 130 moves the carriage 23 from one end to the other end of the sheet facing area, and applies the driving voltage, boosted to the target voltage value, selectively to the driving elements at a timing indicated by the recording command Next, under a condition that there is an image to be recorded on a next recording area, the controller 130 causes the conveyance roller section 54 and the discharge roller section 55 to convey the sheet 12 up to a position at which the next recording area faces the recording head 39. Until the controller 130 records image(s) on all the recording areas, the controller 130 executes the jetting processing and the conveying processing repeatedly. Next, under a condition that the image(s) have been recorded on all the recording areas, the controller 130 causes the discharge roller section 55 to discharge the sheet 12 to the discharge tray 21.

Although not depicted in the drawings, under a condition that a predetermined time has elapsed since the completion of the recording processing (S18), the controller 130 moves the carriage 23 to the maintenance position, changes the state of the switching section 170 into the third state, and moves the cap 71 to the covering position. Further, under a condition that a predetermined time has elapsed since the movement of the cap 71 to the covering position, the controller 130 switches the state of the electric power supply 110 from the driving state to the sleeping state.

According to the embodiment as described above, by releasing the lever 178 from being locked by the third locking section, the driving gear 172 is moved from the second position toward the first position, by the urging force of the spring 180. In this situation, by executing the jiggling in a process during which the driving gear 172 is moving, it is possible to mesh the driving gear 172 and the gear 174 with each other appropriately. In a case that the execution time of the recording processing is relatively short, the execution time of the drive switching processing has a great impact on the FPOT. In view of this, by executing the jiggling three times in the drive switching operation in a case that the second value is set in the execution parameter, it is possible to shorten the FPOT.

Note that the driving gear 172 is smoothly separated away from the gear 176 by the jiggling executed three times, smoothly climbs (passes) over the gear 175, and is smoothly meshed with the gear 174. However, in a case that such an attempt is made that the switching of the meshing state of the gear 172 with respect to the gears 174 to 176 is performed with a small number of times of the jiggling, any small or slight load is consequently accumulated in each of the gears 172 to 177. In view of this, in a case that the execution time of the recording processing is long, even the shortening of the execution time of the drive switching processing does not contribute to the shortening of the FPOT. Therefore, by performing the jiggling five times, it is possible to reduce the load accumulated in each of the gears 172 to 177.

Further, in a case that a time elapsed from the receipt of the preceding command and until the receipt of the recording command is long, even the shortening of the execution time of the drive switching processing does not contribute to the shortening of the FPOT. In view of this, only in a case that the number of times that the jiggling has been executed is still less than three times at the time of receipt of a recording command including the second value "Fine", the number of times for executing the jiggling is made to be three times, thereby making it possible to realize both of the reduction of the FPOT and the reduction of the load accumulated in each of the gears 172 to 177.

The degree of easiness for meshing of the driving gear 172 and the gear 174 to each other is different for every multi-function peripheral 10, due to the effect of any manufacturing error or any assembling error of the driving gear 172 and the gear 174, any degradation of the switching section 170 over time, etc. Further, in a case that the driving gear 172 and the gear 174 cannot mesh with each other in the drive switching processing, any feeding error occurs in the feeding processing. Accordingly, as in the above-described embodiment, in a multi-function peripheral 10 in which the cumulative number of times of the feeding error in the feeding processing is not less than the threshold value, the jiggling is executed five times in the drive switching processing, regardless of the set value of the execution parameter, thereby making it possible to suppress the occurrence of the feeding error.

Modifications

Note that in the above-described embodiment, the explanation has been made regarding the example in which the first preparing processing is executed at a timing at which the preceding command is received, and that the second preparing processing is executed at a timing at which the recording command is received. However, the preceding command can be omitted. Namely, it is allowable that the controller 130 executes the first preparing processing and the second preparing processing (S21 to S27), in response to the receipt of the recording command from the information processing apparatus 51 via the communicating section 50. Then, it is allowable that the controller 130 switches the number of times for executing the jiggling, depending on the result of determination made in each of the steps 13 to S15.

Further, in the above-described embodiment, the explanation has been made regarding the example in which the image recording instruction is obtained (received) from the information processing apparatus 51 via the communicating section 50. However, the method or manner for obtaining (receiving) the image recording instruction is not limited to or restricted by this. As another example, the multi-function peripheral 10 may be further provided with a reading sensor (a so-called scanner) which is configured to read an image recorded on an original (manuscript), and an operation panel via which an operation of a user is received. Then, the controller 130 may obtain (receive), from the user via the operation panel, an image recording instruction for recording an image, read by the reading sensor, on the sheet 12 (a so-called copying instruction). Further, the copying instruction may include an execution parameter indicating a reading resolution by the reading sensor. In the execution parameter in this case, for example, a value which is selected by the user among a first value "600 dpi" and a second value "300 dpi" lower than the first value.

Then, in response to the receipt of the copying instruction via the operation panel, the controller 130 may cause the reading sensor to read the manuscript set in a non-illustrated ADF (Auto Document Feeder) or a non-illustrated contact glass, at a reading resolution indicated by the execution parameter. This processing is an example of a reading processing. Further, in response to the receipt of the copying instruction via the operation panel, the controller 130 may execute the first preparing processing and the second preparing processing in parallel with the reading processing. Then, the controller 130 may switch the number of times for executing the jiggling, which is to be executed in the drive switching processing, depending on the result of determination made in each of steps S13 to S15.

There is such a tendency that the execution time of the reading processing becomes longer as the reading resolution is higher. Further, in a case that the execution time of the reading processing is longer, even the shortening of the execution time of the drive switching processing does not contribute to the shortening of the FPOT. In view of this, only in a case that the reading resolution has the second value "300 dpi", the number of times for executing the jiggling is made to be three times, thereby making it possible to realize both of the reduction of the FPOT and the reduction of the load accumulated in the gears 172 to 177.

Furthermore, in the above-described embodiment, the explanation has been made regarding the example wherein the feeding rollers 25A and 25B, the ascending/descending mechanism for the cap 71, the conveyance roller 60, the discharge roller 62, and the pump 73 are driven by using the feeding motor 101 and the conveyance motor 102. It is allowable, however, that the feeding motor 101 is omitted and that the feeding rollers 25A and 25B, the ascending/descending mechanism for the cap 71, the conveyance roller 60, the discharge roller 62, and the pump 73 are driven by using the conveyance motor 102.

Moreover, in the above-described embodiment, the explanation has been made regarding the case wherein the recording head 39 is caused to jet the ink droplets in the process in which the carriage 23 is being moved in the main scanning direction. However, the recording head of the present teaching is not limited to or restricted by this; it is allowable, for example, that the recording head of the present teaching may be a so-called line head in which the nozzles are arranged over the entire area of the sheet facing area.

Further, in the above-described embodiment, the explanation has been made regarding the case wherein the driving gears 172 and 173 are slid (slidably moved) in the direction of the supporting shaft, to thereby cause the driving gears 172 and 173 to make contact with and to be separated away from the gears 174 to 177. However, the configuration for causing the driving gears 172 and 173 to make contact with and to be separated away from the gears 174 to 177 is not limited to or restricted by the above-described example. As another example, each of the driving gears 172 and 173 may be a so-called pendulum gear. Namely, the driving gears 172 and 173 may swingably move or rockably move in a direction perpendicular to the supporting shaft to thereby mesh with the gears 174 to 177 or to be released from the meshing with the gears 174 to 177.

What is claimed is:

1. An ink-jet printer comprising:

a recording head having nozzles;

a conveyor configured to convey a medium in a conveyance direction;

a motor;

a switching mechanism configured to switch a transmitting state and a non-transmitting state, the transmitting state being a state in which the switching mechanism transmits a driving force of the motor to the conveyor, and the non-transmitting state being a state in which the switching mechanism does not transmit the driving force of the motor to the conveyor, the switching mechanism including:

a first gear movable between a first position and a second position; and a second gear configured to mesh with the first gear, the switching mechanism being switched to the transmitting state under a condition that the second gear is meshed with the first gear located at the first position, and the switching mechanism being switched to the non-transmitting state under a condition that the second gear is separated and away from the first gear being moved to a position different from the first position; and a controller, wherein in a case that the controller obtains an instruction of recording for instructing execution of recording of an image on the medium in accordance with an execution condition indicated by an execution parameter, the controller is configured to perform:

determining whether a set value of the execution parameter is a first value or a second value by which an execution time of the recording of the image on the medium becomes shorter than that by the first value;

causing the first gear to move from the second position toward the first position so as to execute switching of the switching mechanism from the non-transmitting state toward the transmitting state;

under a condition that the controller determines that the set value of the execution parameter is the first value, causing the motor to perform clockwise and counterclockwise rotations for a first number of times in a process during which the controller causes the first gear to move from the second position toward the first position;

under a condition that the controller determines that the set value of the execution parameter is the second value, causing the motor to perform the clockwise and counterclockwise rotations for a second number of times, which is smaller than the first number of times, in the process during which the controller causes the first gear to move from the second position toward the first position;

causing the conveyor to convey the medium up to an initial setting position at which an initial recording area, of the medium, on which the image is to be recorded first, is capable of facing the recording head; and causing the recording head to jet ink selectively from the nozzles, in accordance with the instruction of recording, so as to record the image on the initial recording area, of the medium, facing the recording head.

2. The ink-jet printer according to claim 1, further comprising:

a medium sensor configured to detect the medium, the medium sensor being arranged at a location, in a conveyance route of the medium, upstream from the recording head in the conveyance direction; and a memory configured to store a cumulative number of times for which the medium sensor has not detected the medium in the causing of the conveyor to convey the medium up to the initial setting position previously executed by controller, wherein in the case that the controller obtains the instruction of recording, the controller is configured to execute determining whether or not the cumulative number of times stored in the memory is not less than a threshold value, wherein under a condition that the controller determines that that the cumulative number of times stored in the memory is less than the threshold value, the controller is configured to execute the determining whether the set value of the execution parameter is the first value or the second value, and wherein under a condition that the controller determines that the cumulative number of times stored in the memory is not less than the threshold value, the controller is configured to execute the causing the motor to perform the clockwise and counterclockwise rotations for the first number of times in the process during which the controller causes the first gear to move from the second position toward the first position, regardless of whether the set value of the execution parameter is the first value or the second value.

3. The ink-jet printer according to claim 1, further comprising a communicating section configured to communicate with an external apparatus other than the ink-jet printer, wherein the instruction of recording includes: a recording command including the execution parameter; and a preceding command previously announcing transmittance of the recording command, wherein the controller is configured to start the switching of the switching mechanism from the non-transmitting state to the transmitting state, in a case that the controller receives the preceding command from the external apparatus via the communicating section, wherein in a case that the controller receives the recording command from the external apparatus via the communicating section, the controller is configured to perform determining whether the set value of the execution parameter is the first value or the second value, wherein under a condition that the controller determines that the set value of the execution parameter is the second value, the controller is configured to perform:

determining whether or not a number of times of the clockwise and counterclockwise rotations of the motor is already not less than the second number of times in the process during which the controller causes the first gear to move from the second position toward the first position; and under a condition that the controller determines that the number of times of the clockwise and counterclockwise rotations of the motor is less than the second number of times in the process during which the controller causes the first gear to move from the second position toward the first position, the controller is configured to cause the motor to perform the clockwise and counterclockwise rotations, until the number of times of the clockwise and counterclockwise rotations becomes the second number of times, in the process during which the controller causes the first gear to move from the second position toward the first position; and under a condition that the controller determines that the set value of the execution parameter is the first value, or under a condition that the controller determines that the number of times of the clockwise and counterclockwise rotations of the motor is not less than the second number of times in the process during which the controller causes the first gear to move from the second position toward the first position, the controller is configured to cause the motor to perform the clockwise and counterclockwise rotations, until the number of times of the clockwise and counterclockwise rotations becomes the first number of times, in the process during which the controller causes the first gear to move from the second position toward the first position.

4. The ink-jet printer according to claim 1, wherein the switching mechanism further includes a third gear configured to mesh with the first gear located at the second position, and the controller causes the first gear to be separated and away from the third gear and causes the first gear to mesh with the second gear in a process during which the controller executes the switching of the switching mechanism from the non-transmitting state to the transmitting state.

5. The ink-jet printer according to claim 4, wherein the switching mechanism further includes a fourth gear configured to mesh with the first gear located at a third position between the first and second positions, and wherein the controller causes the first gear to be separated and away from the third gear, to cause the first gear to pass over the fourth gear, and causes the first gear to mesh with the second gear in the process during which the controller executes the switching of the switching mechanism from the non-transmitting state to the transmitting state.

6. The ink-jet printer according to claim 1, further comprising a carriage configured to move the recording head in a scanning direction which crosses the conveyance direction, wherein the switching mechanism includes:

an urging member configured to urge the first gear in a direction from the second position toward the first position; and a holding member configured to be changeable between a holding state in which the holding member holds the first gear at the second position against urging force of the urging member and an allowing state in which the holding member allows the first gear to move toward the first position, and wherein in a process during which the controller executes the switching of the switching mechanism from the non-transmitting state to the transmitting state, the controller is configured to cause the carriage to make contact with the holding member in the holding state to switch the holding member into the allowing state, and the controller is configured to cause the motor to perform normal and reverse rotations.

7. The ink-jet printer according to claim 1, wherein in a case that the execution parameter indicates a resolution of an image to be recorded on the medium, the second value indicates a resolution lower than a resolution indicated by the first value.

8. The ink-jet printer according to claim 1, wherein in a case that the execution parameter indicates a kind of the medium, the first value indicates a glossy paper sheet and the second value indicates a plain paper sheet.

9. The ink-jet printer according to claim 1, wherein in a case that the execution parameter indicates whether or not ink is to be allowed to land on an outer edge of the medium, the first value indicates that the ink is allowed to land on the outer edge, and the second value indicates that the ink is not allowed to land on the outer edge.

10. The ink-jet printer according to claim 1, wherein in a case that the execution parameter indicates whether or not the image is to be recorded on both surfaces of the medium, the first value indicates that the image is to be recorded on both surfaces of the medium, and the second value indicates that the image is to be recorded only on one of the surfaces of the medium.

11. The ink-jet printer according to claim 1, wherein in a case that the execution parameter indicates a format of data indicating the image is to be recorded on the medium, the first value indicates an image format, and the second value indicates a document format.

12. The ink-jet printer according to claim 1, further comprising:

a reading sensor configured to read an image recorded on a medium; and an operation panel configured to receive a user-operation, wherein the instruction of recording is an instruction for recording, on the medium, an image read by the reading sensor at a reading resolution indicated by the execution parameter, wherein the second value indicates a reading resolution lower than a reading resolution indicated by the first value, and wherein the controller is configured to control:

the reading sensor to read the image recorded on the medium, in a case that the controller receives the instruction of recording via the operation panel, and the recording head to perform recording of the image, read by the reading sensor, on the medium.

* * * * *